US006894664B2

(12) United States Patent
Thébault et al.

(10) Patent No.: US 6,894,664 B2
(45) Date of Patent: May 17, 2005

(54) METHOD AND APPARATUS FOR PROCESSING VIDEO PICTURES

(75) Inventors: Cédric Thébault, Sevran (FR); Carlos Correa, Villingen-Schwenningen (DE); Sébastien Weitbruch, Mönchweiler (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 188 days.

(21) Appl. No.: 10/125,112

(22) Filed: Apr. 18, 2002

(65) Prior Publication Data

US 2003/0063107 A1 Apr. 3, 2003

(30) Foreign Application Priority Data

May 8, 2001 (EP) ..... 01250158

(51) Int. Cl.[7] ..... G09G 3/28
(52) U.S. Cl. ..... 345/60; 345/690; 345/89
(58) Field of Search ..... 345/60–67, 68, 345/690, 72, 89, 211–214, 692

(56) References Cited

U.S. PATENT DOCUMENTS 6,091,396 A 7/2000 Minami et al.
6,473,464 B1 * 10/2002 Weitbruch et al. ..... 375/240.26
6,674,429 B1 * 1/2004 Correa et al. ..... 345/211
6,680,716 B2 * 1/2004 Nakamura ..... 345/60

FOREIGN PATENT DOCUMENTS

EP 1026655 8/2000

OTHER PUBLICATIONS

Hashimoto et al. Japan–Pub. No. 11–045070.*
Takayama et al. Japan–Pub. No. 2000–24226.*
Someya et al. Japan Pub. No. 10–307561.*
Hashiguchi et al. Japan Pub. 2002–023692.*

European Search Report.

Patent Abstracts of Japan Pub. No. 200242226 Published Aug. 9, 2000 Fujitsu Ltd. Hashimoto Yasunobu Grey Level Display Method and Display Device.

Copy of European Search Report.

Patent Abstracts of Japan Pub. No. 200242226 Published Aug. 9, 2000 Fujitsu Ltd. Hashimoto Yasunobu Grey Level Display Method and Display Device.

* cited by examiner

*Primary Examiner*—Regina Liang
*Assistant Examiner*—Jennifer T. Nguyen
(74) *Attorney, Agent, or Firm*—Joseph S. Tripoli; Harvey D. Fried; Sammy S. Henig

(57) ABSTRACT

A method and apparatus for processing video pictures for dynamic false contour effect compensation is provided wherein the video picture consists of pixels having at least one color component (RGB) the color component values being digitally coded with a digital code word, hereinafter called sub-field code word (SF-R, SF-G, F-B). To each bit of a sub-field code word (SF-R, SF-G, SF-B) a certain duration is assigned hereinafter called a sub-field, during which a color component of the pixel can be activated for light generation. The digital code words have n bits, characterized in that among a set p possible video levels for the at least one color component (RGB) a sub-set of m video levels with n<m<p is selected, which is used for light generation. The m values are selected according to the rule that the temporal center of gravity (CG1, CG2, CG3) for the light generation of the corresponding sub-field code words grow continuously with the video level, apart from possible exceptions in the low video level range up to a first predefined limit and/or in the high video level range from a second predefined limit on.

8 Claims, 10 Drawing Sheets

METHOD AND APPARATUS FOR PROCESSING VIDEO PICTURES

BACKGROUND OF THE INVENTION

The invention relates to a method and apparatus for processing video pictures, especially for dynamic false contour effect compensation. This method and apparatus is usable in display devices, such as matrix displays like plasma display panels (PDP), display devices with digital micro mirror arrays (DMD) and all kinds of displays based on the principle of duty cycle modulation (pulse width modulation) of light generation.

The plasma display technology now makes it possible to achieve flat colour panels of large size and with limited depth without any viewing angle constraints. The size of the displays may be much larger than the classical CRT picture tubes would have ever allowed.

A plasma display panel utilizes a matrix array of discharge cells, which could only be "on" or "off". Also unlike a CRT or LCD in which grey levels are expressed by analogue control of the emission, a PDP controls the grey levels by modulating the number of light pulses per frame (sustain pulses). The eye will integrate this time-modulation over a period corresponding to the eye-time response.

Since the video amplitude determines the number of light pulses occurring at a given frequency, more amplitude means more light pulses and thus more "on time". For this reason this kind of modulation is known as PWM, Pulse Width Modulation. To establish a concept for this PWM, each frame will be decomposed in sub-periods called "sub-fields". For producing the small light pulses, an electrical discharge appears in a gas filled cell, called plasma cell and the produced UV radiation will excite a coloured phosphor, which emits light. In order to select which cell should be lighted, a first selected operation called "addressing" creates a charge in the cell to be lighted. Each plasma cell can be considered as a capacitor, which keeps the charge for a relative long time. Afterwards, a general operation called "sustaining" applied during the lighting period will accelerate the charges in the cell, produce further charges and excite some of the charges in the cell. Only in the cells addressed during the first selected operation, this excitation of charges takes place and UV radiation is generated when the excited charges go back to their neutral state. The UV radiation excites a phosphorous for light emission. The discharge of the cell is made in a very short period and some of the charges in the cell remain. With the next sustain pulse, the charge is utilized again for the generation of UV radiation and the next light pulse will be produced. During the whole sustain period of each specific sub-field, the cell will be lighted in small pulses. At the end an erase operation will remove all the charges to prepare a new cycle.

On one hand, the plasma display technology gives the possibility of nearly unlimited screen size, also of attractive thickness, but on the other hand, it generates new kinds of artefacts, which could damage the picture quality. Most of these artefacts are different from the known artefacts occurring on classical CRT colour picture tubes. It is mainly this different appearance of the artefacts that make them more visible to the viewer, since the viewer is used to see the well-known TV artefacts.

The invention mainly deals with a new specific artefact, which is called "dynamic false contour effect" since it corresponds to disturbances of grey levels and colours in form of an apparition of coloured edges in the picture when an observation point on the matrix screen moves. This kind of artefact is enhanced when the image has a smooth gradation, like when the skin of a person is being displayed (e.g. displaying of a face or of an arm, etc.). In addition, the same problem occurs on static images when observers are shaking their heads and that leads to the conclusion that such a failure depends on the human visual perception and happens on the retina of the eye.

In the prior art some approaches are already known to compensate for the false contour effect. As a false contour effect is directly related to the sub-field organization of the used plasma technology, one approach is to make an optimisation of the sub-field organization of the plasma display panels. The sub-field organization will be explained in greater detail below, but for the moment it should be noted that it is a kind of decomposition of the 8 bit grey level in 8 or more lighting sub-periods. An optimisation of such a picture encoding will have, indeed, a positive effect on the false contour effect. Nevertheless, such a solution can only slightly reduce the false contour effect amplitude but in any case the effect will still occur and will be perceivable. Furthermore, the sub-field organization is not a simple matter of design choice. The more sub-fields are allowed the less luminance the panel will be able to produce. So optimisation of the sub-field organization is only possible in a narrow range and will not eliminate this effect alone.

A second approach for the solution of above mentioned problem is known under the expression "pulse equalization technique". This technique is a more complex one. It uses equalizing pulses, which are added or separated from the TV signal when disturbances of grey scale are foreseen. In addition, since the fact that the false contour effect is motion relevant, different pulses for each possible speed are necessary. That leads to the need of a big memory storing a large number of look-up tables (LUT) for each speed and there is a need of a motion estimator. Furthermore, since the false contour effect depends on the sub-field organization, the pulses have to be recalculated for each new sub-field organization. However, the big disadvantage of this technique results from the fact that the equalizing pulses add failures to the picture to compensate for a failure appearing on the eye retina. Additionally, when the motion increases in the picture, there is a need to add more pulses to the picture and that leads to conflicts with picture contents in case of very fast motion.

A further approach which is described in prior art documents, like EP-A-0 980 059, is based on a detection of the movements in the picture (displacement of the eye focus area) and the spreading of the right sub-field lighting periods over this displacement in order to ensure that the eye will only perceive the correct information through its movement. This solution requires a motion estimator, which delivers motion vector data for the pixels or pixel blocks. For each pixel the corresponding motion vector data is used to shift the entries in the sub-field code word in the direction of the motion vector. Thus the sub-field code words are corrected or recoded. The solution is good, and gives a good picture quality but, of course, has a need of an implementation of a motion estimator, which makes the high speed motion estimation. This motion estimator is relatively costly and not easy to implement.

Another approach for compensating the dynamic false contour effect is based on a new type of sub-field coding. Which is called "incremental sub-field coding". The incremental sub-field coding method is disclosed for example in the European Patent Publication EP-A-0 952 569. In this type of sub-field coding method, there are only some basic sub-field code words used for the grey scale portrayal rendition. This means, that in the case of 8 bit video data there are not 256 different sub-field code words for the possible video levels, but instead only a few sub-field code words with specific characteristic for some distinct video levels and the remaining video levels are rendered by some optimised dithering or error diffusion technique. The speciality of the incremental code is that in each case there is never one sub-field inactivated between two consecutive activated sub-fields and never one sub-field activated between two consecutive inactivated sub-fields. With this characteristic the incremental code has the advantage, that false contour effect is no longer a problem due to the fact that sub-field code words for similar video levels cannot deviate at various bit positions.

The structure of such sub-field code words is very specific and varies from code word to code word in only one sub-field entry. This means that when there is a smooth transition of video levels like in a homogenous surface, as skin, then there will no longer occur the changes in the structure of sub-field code words, which can cause false contour effect. The number of available video levels is, however, substantively reduced so that a poor grey scale rendition results. To improve this grey scale rendition, a dithering technique is required, which brings back some of the lost video levels. It is hardly possible to bring back all the lost video levels with such a dithering technique or error diffusion technique in the case of this specific sub-field coding, where the number of grey levels is reduced to the number of sub-fields in the sub-field organization.

SUMMARY OF THE INVENTION

It is an object of the present invention to disclose a method and an apparatus for processing video pictures, which achieve an efficient false contour effect compensation based on a new type of sub-field coding without the need of having a motion estimator but with an improved grey scale rendition, so that less dithering noise is produced. This object is achieved by the solution claimed in independent claims 1 and 7.

According to the claimed solution in claim 1, a new type of sub-field coding is used based on a sub-field organization with n sub-fields, in which among the set of p possible video levels for a colour component a sub-set of m video levels is selected with $n<m<p$ wherein the m values are selected according to the rule that the temporal centre of gravity for the light generation of the corresponding sub-field code words grows continuously apart from exceptions in the low video level range up to a first predefined limit and/or in the high video level range from a second predefined limit on. While according to the incremental coding described above only very few video levels are admissible for sub-field coding, namely as much as sub-fields are available in the sub-field organization, the sub-field coding method according to the invention relies on more video levels and thus provides for a better grey scale rendition and less disturbing dithering noise. The admissible video levels according to the inventive solution cannot be arbitrarily taken from the full video level range but are selected with a specific rule, namely that the temporal centre of gravity of admissible sub-field code words grows smoothly when the video levels are ordered according to size. There are only some exceptions allowable in the low video level range and in the high video level range.

It is not possible to select video levels with growing gravity centre in the low level range because the number of possible video levels is low and so if only smoothly growing centre of gravity levels where selected, then there would not be enough video levels to have a good video quality in the black/dark video levels, since the human eye is very sensitive in the dark/black level range. But this is not so disturbing because the false contour effect is negligible in dark areas.

In the high video level range, there is a decrease of the centres of gravity anyhow, so here, also in the chosen video levels a decrease is accepted. Of course this can cause dynamic false contour effect, but this is not so important in this range since the human eye is not sensitive in the high video level range. This will be explained in more detail later on.

In between the low level and high video level range the admissible video levels and their corresponding sub-field code words follow a monotone rising curve and thus in this range the dynamic false contour effect does not occur.

In summary, with the sub-field coding method according to the invention a good compromise has been found in regards to dynamic false contour effect reduction and grey scale rendition. A very good picture quality is maintained. Advantageously additional embodiments of the inventive method are disclosed in the respective dependent claims.

It is very advantageous, if the sub-field coding process respects the rule that for all input video levels that are different from zero a sub-field code word is selected, in which never more than one consecutive sub-field is inactivated between two activated sub-fields. This rule drastically reduces the number of possible sub-field code words, so that for setting up the sub-set of m video levels the choice of video levels and corresponding sub-field code words is simplified. Taking only those sub-field code words and corresponding video levels respecting above mentioned rule has the additional advantage that the response fidelity of the plasma cells in case of a plasma display panel is subjectively increased. This is because the distance in time between two writing periods for a plasma cell is reduced, so that the probability of a correct pre-charging of the plasma cell during the writing period is increased. With sub-field coding methods not respecting this rule the problem can arise that some plasma cells show some sort of flickering because they are not correctly lighted in each video frame.

Advantageous features for an apparatus according to the invention are claimed in claims 5 to 7. The sub-set of m video levels can be stored advantageously in a look-up table for the sub-field coding process.

As the plasma display panels have a linear response characteristic, it is advantageous to provide a Degamma unit, in which the input video levels are compensated for the gamma correction in the video source.

Also it is advantageous to provide a dithering unit, in which dithering values are added to the output values of the Degamma unit to increase the grey scale portrayal. As known from the dithering technique, in the dithering unit a truncation of the video level data is performed to the bit resolution, which is required for the number m of video levels in the selected sub-set. This video level data is input to the look-up table for the sub-field coding process. This look-up table can be designed to not include the sub-field code word but instead the full resolution video level word (preferably 8 bit). This allows implementing the dynamic false contour compensation method at the video level processing stage, i.e. before sub-field coding so that the method can be simply implemented very easily on any panel type.

BRIEF DESCRIPTION OF THE DRAWINGS

Exemplary embodiments of the invention are illustrated in the drawings and in more detail in the following description.

In the figures.

DESCRIPTION OF THE PREFERRED EMBODIMENTS

Figure 1:
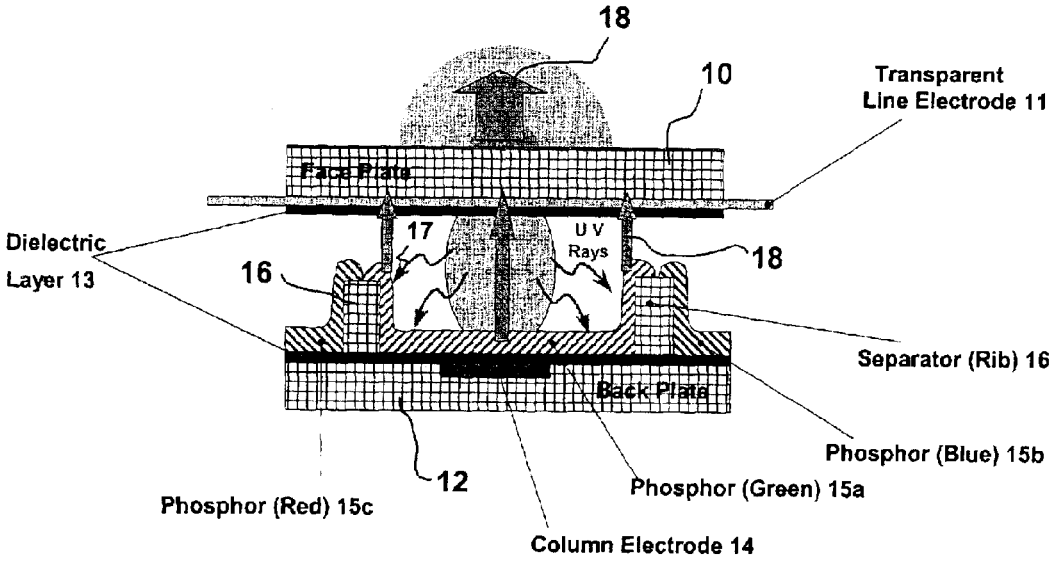
FIG. 1 shows the structure of a plasma display panel cell in the matrix technology.

The principle structure of a plasma cell in the so-called matrix plasma technology is shown in FIG. 1. Reference number 10 denotes a face plate made of glass, with reference number 11 a transparent line electrode is denoted. The back plate of the panel is referenced with reference number 12. There are 2 dielectric layers 13 for isolating face and back plate against each other. In the back plate column electrodes 14 are integrated being perpendicular to the line electrodes 11. The inner part of the cells consists of a luminance substance 15 (phosphorous) and separator 16 for separating the different coloured phosphorous substances (green 15*a*) (blue 15*b*) (red 15*c*). The UV radiation caused by the discharge is denoted with reference number 17. The light emitted from the green phosphorous 15*a* is indicated with an arrow having the reference number 18. From this structure of a PDP cell it is clear that there are three plasma cells necessary, corresponding to the three colour components RGB to produce the colour of a picture element (pixel) of the displayed picture.

The grey level of each R, G, B component of a pixel is controlled in a PDP by modulating the number of light pulses per frame period. The eye will integrate this time modulation over a period corresponding to the human eye response. The most efficient addressing scheme should be to address n times if the number of video levels to be created is equal to n. In case of the commonly used 8 bit representation of the video levels, a plasma cell should be addressed 256 times according to this. But this is not technically possible, since each addressing operation requires a lot of time (around 2 $\mu$s per line>960 $\mu$s for one addressing period>245 ms for all 256 addressing operations), which is more than the 20 ms available time period for 50 Hz video frames.

Figure 2:
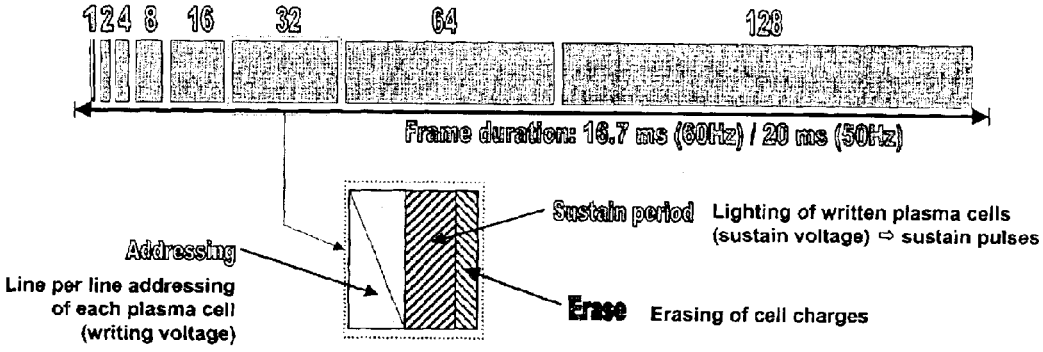
FIG. 2 shows the conventional ADS addressing scheme during a frame period.

From the literature a different addressing scheme is known, which is more practical. According to this addressing scheme a minimum of 8 sub-fields (in case of an 8 bit video level data word) are used in a sub-field organization for a frame period. With a combination of these 8 sub-fields it is possible to generate the 256 different video levels. This addressing scheme is illustrated in FIG. 2. In this figure each video level for each colour component will be represented by a combination of 8 bits with the following weights:

1/2/4/8/16/32/64/128

To realize such a coding with the PDP technology, the frame period will be divided in 8 lighting periods called sub-fields, each one corresponding to a bit in a corresponding sub-field code word. The number of light pulses for the bit "2" is double as for the bit "1" and so forth. With these 8 sub-periods it is possible, through sub-field combination, to build the 256 grey levels. The standard principle to generate this grey level rendition is based on the ADS (Address Display Separated) principle, where all operations are performed at different times on the whole display panel. At the bottom of FIG. 2 it is shown that in this addressing scheme each sub-field consists of three parts, namely an addressing period, a sustaining period and an erasing period.

In the ADS addressing scheme all the basic cycles follow one after the other. At first, all cells of the panel will be written (addressed) in one period, afterwards all cells will be lighted (sustained) and at the end all cells will be erased together.

Figure 3:
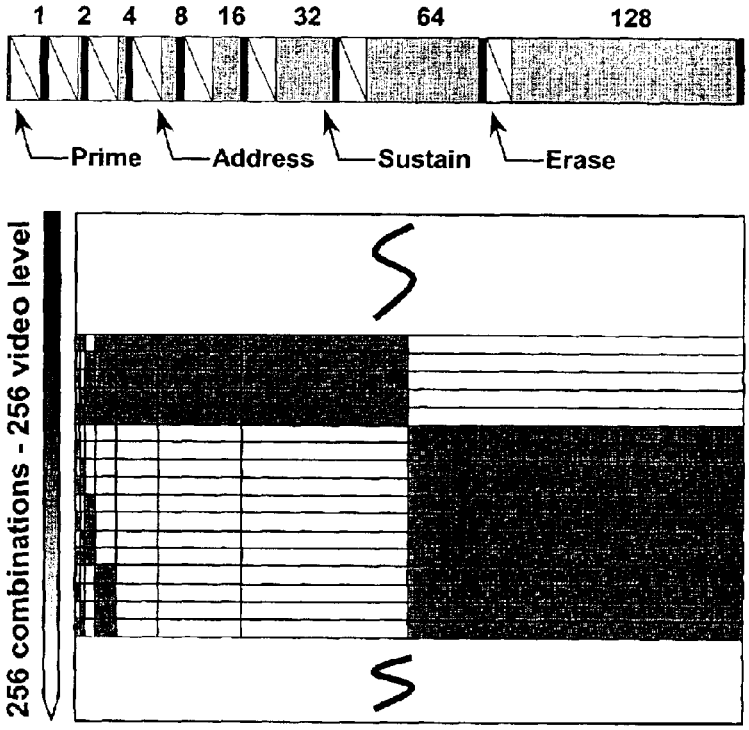
FIG. 3 shows the standard sub-field encoding principle for the ADS addressing scheme and priming.

The sub-field organization shown in FIG. 2 is only a simple example and there are very different sub-field organizations known from the literature with e.g. more sub-fields and different sub-field weights. Often more sub-fields are used to reduce moving artefacts and "priming" could be used on more sub-fields to increase the response fidelity. Priming is a separate optional period, where the cells are charged and erased. This charge can lead to a small discharge, i.e. can create background light, which is in principle unwanted. After the priming period an erase period follows for immediately quenching the charge. This is required for the following sub-field periods, where the cells need to be addressed again. So priming is a period, which facilitates the following addressing period, i.e. it improves efficiency of the writing stage by regularly exciting all cells simultaneously. The addressing period length can be equal for all sub-fields, also the erasing period length. However, it is also possible that the addressing period length is different for a first group of sub-fields and a second group of sub-fields in a sub-field organization. In the addressing period, the cells are addressed line-wise from line 1 to line n of the display. In the erasing period all the cells will be discharged in parallel in one shot, which does not take as much time as for addressing. The example in FIG. 3 shows the standard sub-field organisation with 8 sub-field inclusive the priming operation. At one point in time there is one of these operations active for the whole panel.

Figure 4:
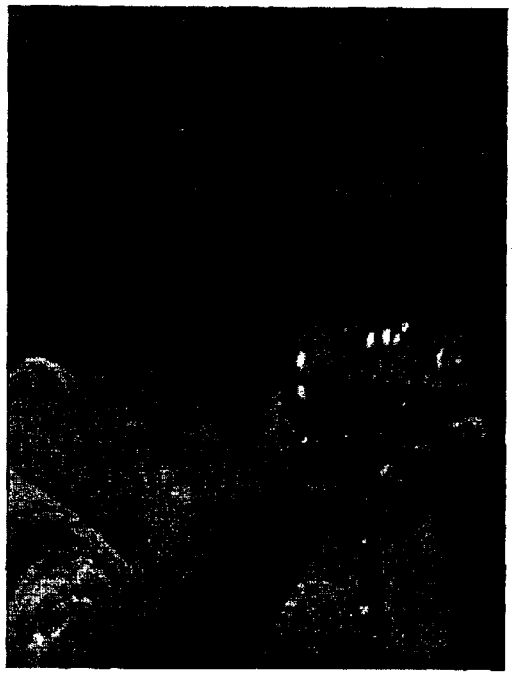
FIG. 4 shows a video picture, in which the false contour effect is simulated.

FIG. 4 shows the artefact due to the false contour effect. On the arm of the displayed woman two dark lines are shown, which for example are caused by this false contour effect. Also in the face of the woman such dark lines occur at the right side.

As mentioned above, a plasma display panel utilizes a matrix array of discharge cells, which can only be switched on or off. In a PDP modulating the number of light pulses per video frame controls the grey level of each colour component. The eye will integrate this time modulation over a period corresponding to the eye time response. Without motion, the eye of the observer will integrate over about a frame period these small light impulses and catch the impression of the correct grey level.

Figure 5:
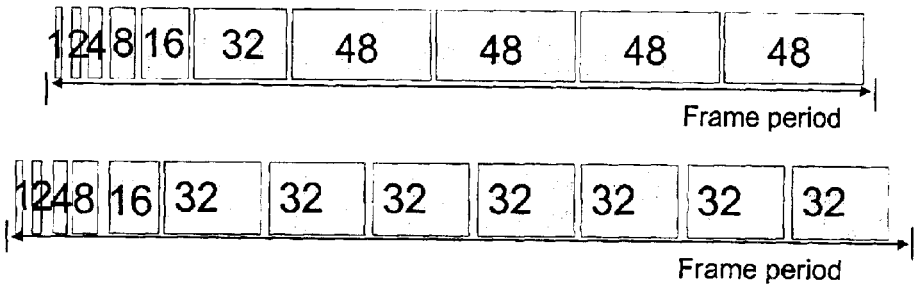
FIG. 5 shows two different sub-field organization schemes.

When an observation point (eye focus area) on the PDP screen moves, the eye will follow this movement. Consequently, it will no longer integrate the light from the same cell over a period (static integration) but it will integrate information coming from different cells located on the movement trajectory. Thus it will mix all the light pulses during this movement, which leads to a faulty signal information. This effect will now be explained in more detail below. In the field of plasma video encoding, the use of more than 8 sub-fields to represent the 256 original video levels is very common. This aims at reducing the weights of the MSBs, which are directly linked to the maximum level of false contour generated. The first example of such a sub-field organization based on 10 sub-fields is shown in the upper part of FIG. 5. A sub-field organization based on 12 sub-fields is shown in the lower part of FIG. 5. Of course, the sub-field organizations shown in FIG. 5 are only examples and the sub-field organization can be subject of modification for other embodiments.

The light emission pattern according to the sub-field organization introduces new categories of image quality degradation corresponding to disturbances of grey levels and colours. As already explained, these disturbances are defined as so called dynamic false contour effects, since the fact that they correspond to the appearance of coloured edges in the picture when an observation point on the PDP screen moves. The observer has the impression of a strong contour appearing on a homogeneous area like displayed skin. The degradation is enhanced when the image has a smooth gradation and also when the light emission period exceeds several ms. So, in dark scenes the effect is not so disturbing as in scenes with average grey level (e.g. luminance values from 32 to 223). In addition the same problem occurs in static images when observers shake their head, which leads to the conclusion that such a failure depends on the human visual perception. To better understand the basic mechanism of visual perception of moving images, a simple case will be considered. Let us assume a transition between the luminance levels 128 and 127 moving at a speed of 5 pixels per video frame and the eye is following this movement.

Figure 6:
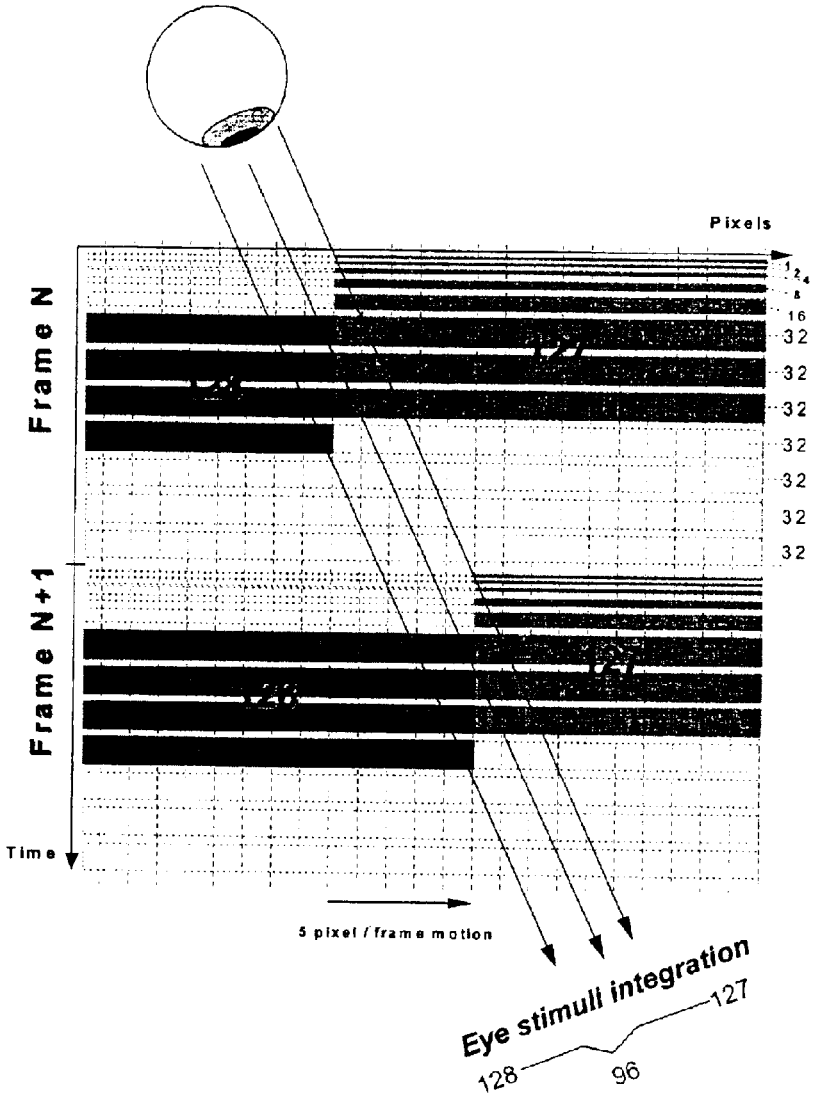
FIG. 6 shows an illustration for explaining the false contour effect.

FIG. 6 shows a darker shaded area corresponding to the luminance level 128 and a lighter shaded area corresponding to the luminance level 127. The sub-field organization shown in FIG. 2 is used for building the luminance levels 128 and 127 as it is depicted in the right side of FIG. 6. The three parallel lines in FIG. 6 indicate the direction in which the eye follows the movement. The two outer lines show the area borders where a faulty signal will be perceived. Between them the eye will perceive a lack of luminance, which leads to the appearance of a dark edge in the corresponding area, which is illustrated in FIG. 6 at the bottom. The effect that the lack of luminance will be perceived in the shown area is due to the fact that the eye will no longer integrate all lighting periods of one pixel when the point from which the eye receives light is in movement. Only part of the light pulses will probably be integrated when the point moves. Therefore, there is a lack of corresponding luminance and a dark edge will occur.

Figure 7:
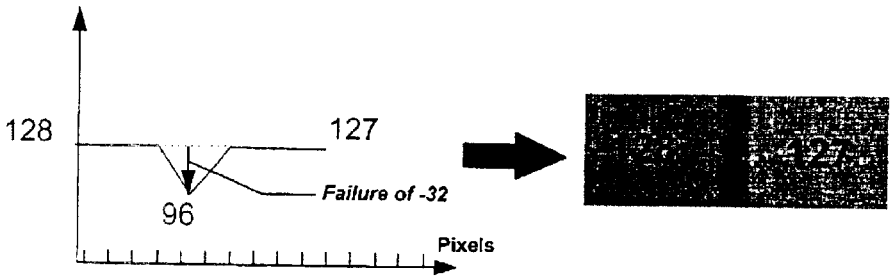
FIG. 7 illustrates the appearance of a dark edge when a display of two frames is made in the manner shown in FIG. 6.

On the left side of FIG. 7, a curve is shown, which illustrates the behaviour of the eye cells during observing a moving picture depicted in FIG. 6. The eye cells having a good distance from the horizontal transition will integrate enough light from the corresponding pixels. Only the eye cells, which are near the transition, will not be able to integrate a lot of light from the same pictures. In case of grey scale this effect corresponds to the apparition of artificial white or black edges. In the case of coloured pictures, since this effect will occur independently on the different colour components, it will lead to the apparition of coloured edges in homogeneous areas like skin. In a colour TV PDP, the same phenomenon will appear on the three components (RGB) but with different intensities depending on the colour level and its encoding in sub-fields. This will lead to coloured edges appearing on the picture and this is very annoying since they are unnatural. Furthermore, this effect will also occur in case of a sharp transition, e.g. a transition from white to black video level and combined with phosphor lag effect, this leads to a strong degradation of the sharpness of moving objects.

It is evident that from the explanation above that the false contour effect occurs when there is a transition from one level to another with a totally different sub-field code word. It is, therefore, an idea of the invention to make a specific selection of sub-field code words among the $2^n$ possible sub-field arrangements, where n is the number of sub-fields in a sub-field organization, to verify that video levels with similar size will have sub-field code words with similar structure. The input video levels for the different colour components are usually given in an 8 bit binary code so that 256 different video levels are provided. The number p is the number of possible video levels, i.e. with 8 bit p=256. According to the invention, only a sub-set of these possible video levels will be used for sub-field coding, where m is the number of video levels in the selected sub-set. The relationship between m and p is m<p. A problem is how to select the m grey levels for the sub-set and the corresponding sub-field code words among the $2^n$ possible sub-field arrangements in order to avoid the occurrence of false contour effect. A compromise has to be found between selecting only those video levels and sub-field code words in order to avoid the false contour problematic on the one hand and on the other hand to keep a maximum of video levels in order to have the best video quality. Experiments have shown that an acceptable compromise between the number of video levels and a good false contour reduction is given if a minimum of selected video levels for the sub-set is equal to twice the number of sub-fields in the selected sub-field organization.

How to select the correct sub-field code words and corresponding video levels for the sub-set, is a more sophisticated problem but it can be solved relatively easily as will be shown hereinafter in the following explanations.

Figure 8:
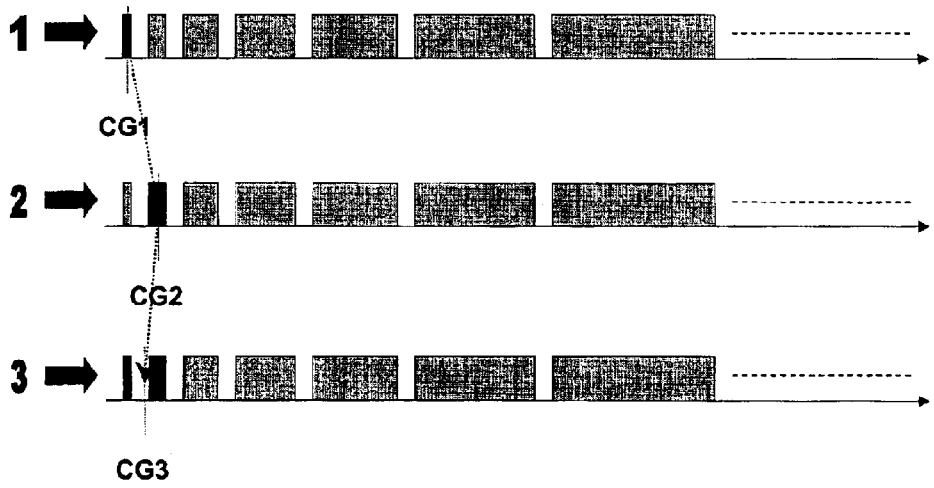
FIG. 8 illustrates that the temporal centre of gravity of the light generation is not growing monotonously with the video levels.

As described above a PDP emits light pulses in pulse width modulation form and the human eye integrates these light pulses during a frame period in order to perceive the correct brightness impression. In FIG. 8 it is indicated how the temporal centre of gravity CG1, CG2, CG3 of light emission varies when the video level is incremented one by one in case of a basic sub-field code like the well-known binary code. A vertical line indicates the temporal centre of gravity. A dark shaded sub-field means that during this sub-field the light generation is activated whereas a light shaded sub-field means that there is no light generation in this sub-field period. From FIG. 8 it is evident that the temporal centre of gravity CG1, CG2, CG3, etc. is not growing smoothly (monotonously) with the video level. And it is this behaviour that makes this type of sub-field coding sensitive to false contour effect. The mathematical exact definition of the temporal centre of gravity of the light generation according to a sub-field code word is defined in the following formula:

$$CG(\text{code}) = \frac{\sum_{i=1}^{n} sfW_i * \delta_i(\text{code}) * sfCG_i}{\sum_{i=1}^{n} sfW_i * \delta_i(\text{code})}$$

Figure 9:
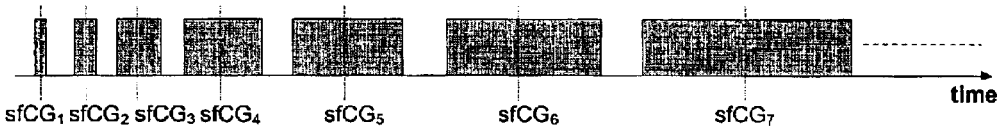
FIG. 9 shows the centre of gravity time positions for the sub-fields within a sub-field organization.

In this formula $sfW_i$ is a sub-field weight of the $i^{th}$ sub-field, $\delta_i$ is equal to 1 if the $i^{th}$ sub-field is "switched on" according to the sub-field code word and 0 otherwise. The temporal centre of gravity of the $i^{th}$ sub-field is named $sfCG_i$ in this formula. FIG. 9 shows for each sub-field in a sub-field organization its corresponding temporal centre of gravity, again indicated by a vertical line.

In the next figure, FIG. 10, the temporal centres of gravity of all 256 video levels are shown in form of a curve for a sub-field organization with 11 sub-fields and sub-field weights as shown below:

1 2 3 5 8 12 18 27 41 58 80

The temporal centre of gravity is calculated with the formula presented above. The curve in FIG. 10 is by far not monotonous and includes a lot of jumps. It is the recognition of the invention that these jumps cause false contour effect.

Figure 11:
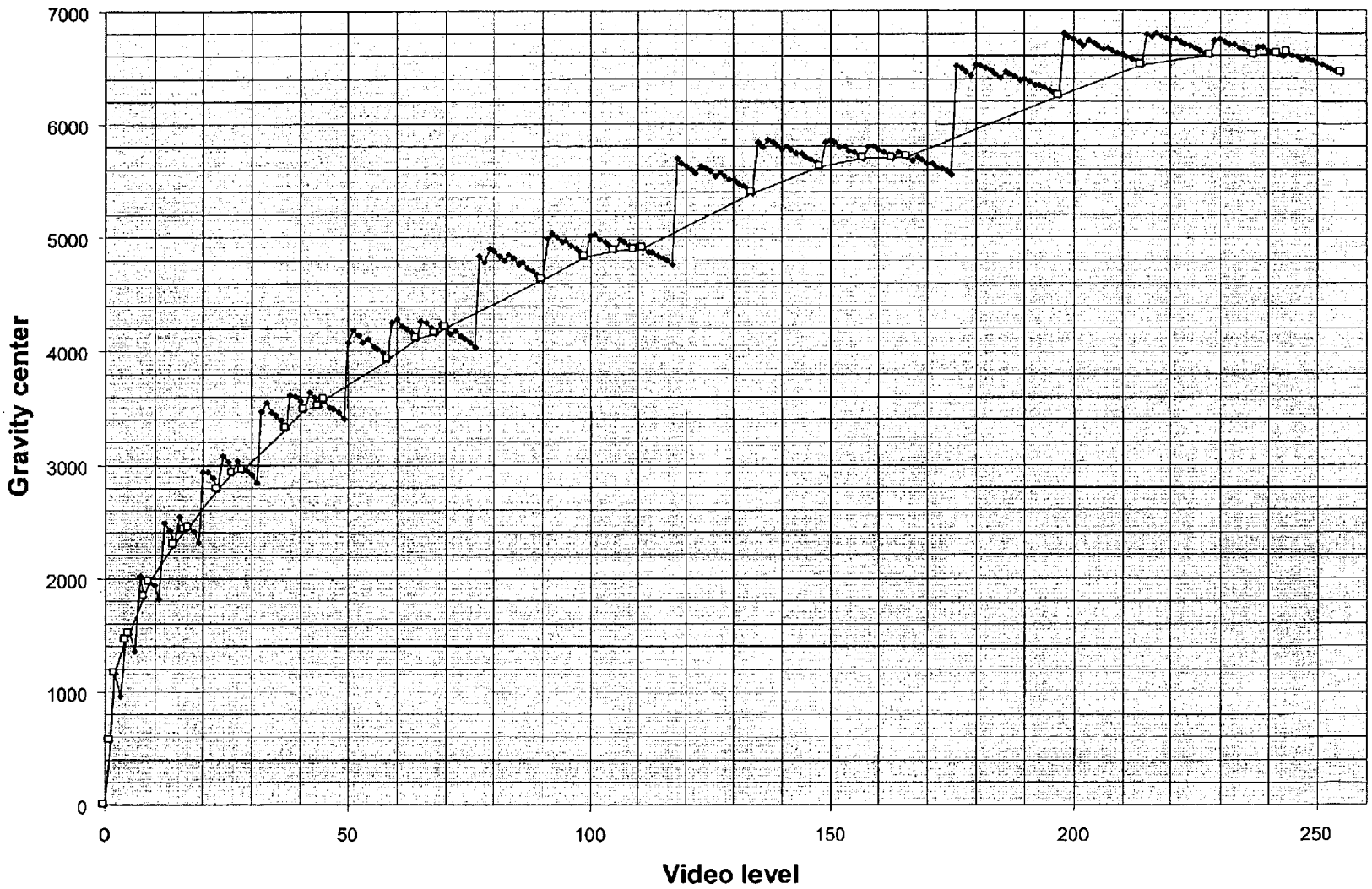
FIG. 11 shows a monotone rising curve with the selected points in the temporal centre of gravity versus video level coordinate system and the sub-set of selected points for sub-field encoding.

In order to avoid this, it is therefore the idea of the invention to suppress these jumps by selecting only some video levels, for which the corresponding sub-field code words have temporal centres of gravity, which will grow smoothly. This can be done by drawing a monotone curve without jumps in the previous graphic and selecting in each case the nearest point. A lot of best fitting techniques are known for this purpose from the mathematics, e.g. Gaussian fit method, which relies on minimization of the square errors. Of course, this is only one embodiment of the invention. An example of a monotonous curve is shown in FIG. 11. The selected video levels for the sub-set of video levels are indicated with small black squares. Next, a more sophisticated embodiment is described.

In the low video level range it is not always sufficient to respect the above mentioned rule to only select those video levels where the temporal centre of gravity is smoothly growing, because in this range the number of possible levels is low and so if only growing temporal centre of gravity levels were selected, there would not be enough video levels to provide a good video quality in dark pictures, since the human eye is very sensitive in the dark video picture range. On the other hand the false contour effect in the dark video picture range is negligible anyhow, so that it is acceptable that in this range the above-mentioned rule is violated.

Figure 10:
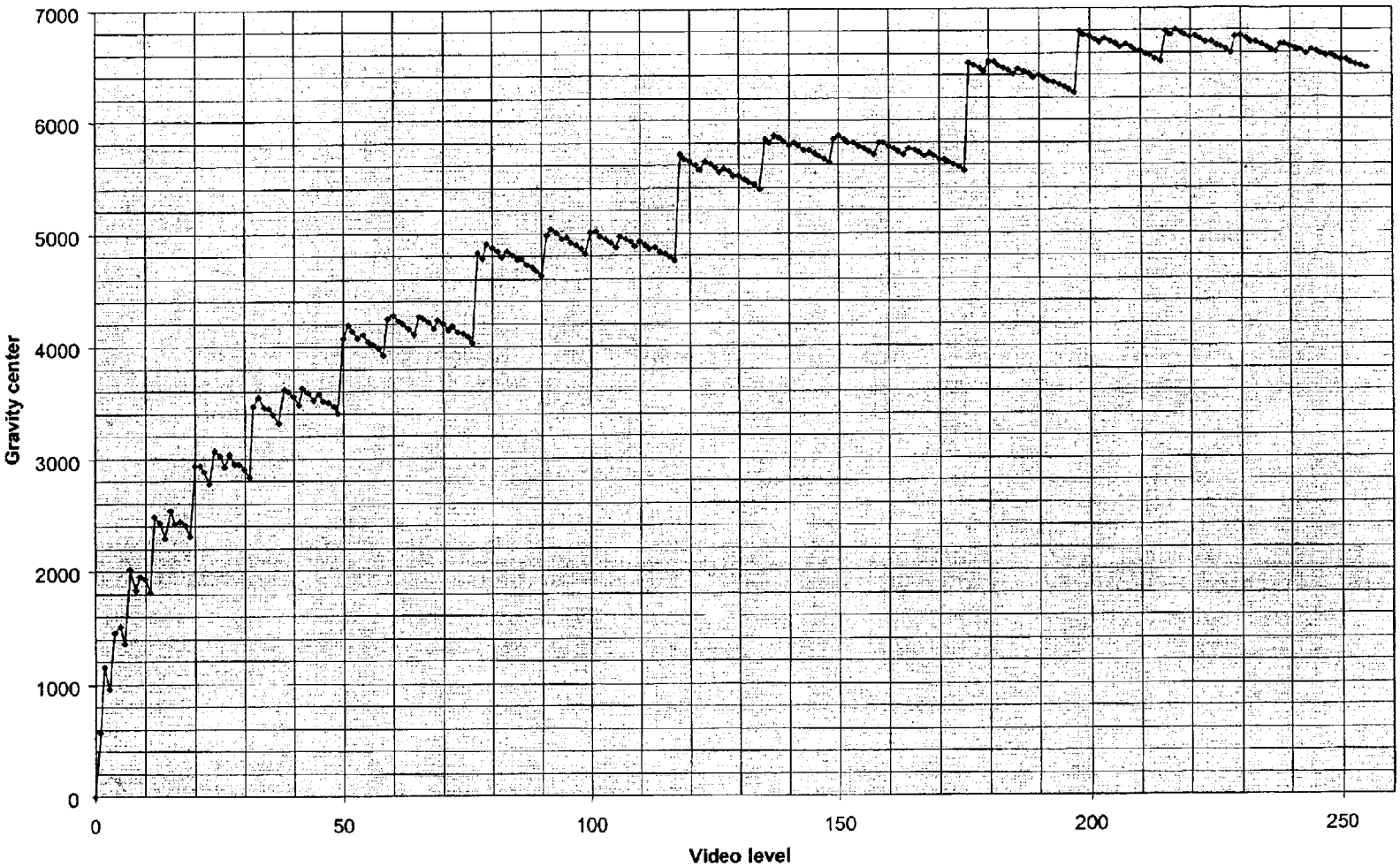
FIG. 10 illustrates the behaviour of the centre of gravity variation in a temporal gravity centre versus video level curve.

In the high video level range, there is a decrease of the temporal centre of gravity, which is evident when looking at FIG. 10. As soon as the sub-field with the highest sub-field weight is lighted, only some lower sub-fields can be lighted having a previous time position, which leads to a reduction of the overall temporal centre of gravity for the light emissions. Thus, also in this video level range the above given rule cannot be respected. In this area, the human eye is not very sensitive of distinguishing the different video levels and, therefore, it is not so important that the above-mentioned rule is respected. The occurring false contour effect is negligible in this video level range. This is in accordance with the Weber-Fechner law, which specifies that the eye is only sensitive to relative video amplitude changes. In the high video level range the relative video amplitude changes are low in comparison to the low or mid video level range. For these reasons, the above mentioned rule, that only those video levels and corresponding sub-field code words are selected for setting up the sub-set of video levels can be revised to the less strict rule that the monotony of the curve is only required in the video level range between a first and a second limit. With experiments it has been verified that for example 10% of the maximum video level is an appropriate level for the low video level range and 80% of the maximum video level is an appropriate level for the high video level range.

In the example shown in FIG. 11 37 video levels (m=37) are selected for the sub-set among the 256 possible video levels. These 37 levels permit to keep a good video quality (grey scale portrayal).

Figure 12:
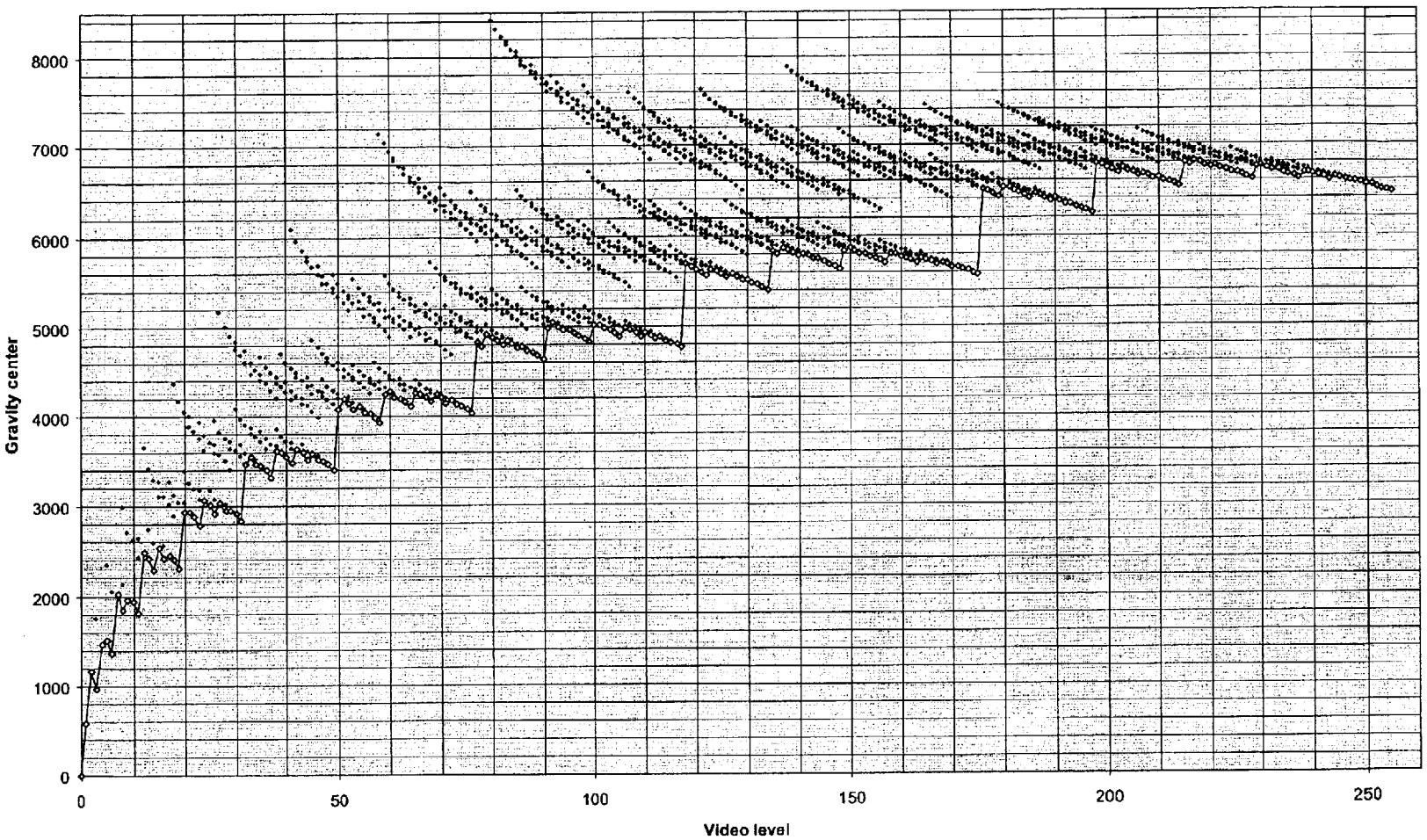
FIG. 12 illustrates all possible points in the temporal centre of gravity versus video level coordinate system for a sub-field organization with 11 sub-fields.

Except for very simple sub-field organizations (up to 8 sub-fields) this selection can be directly made on the video level basis. For all other sub-field organizations with 9 and more sub-fields the choice is more difficult. This is illustrated in FIG. 12. If there are p sub-fields in a sub-field organization, there are $2^p$ different sub-field arrangements.

In FIG. 12 all possible sub-field code words for a sub-field organization with 11 sub-fields are shown. In case of 11 sub-fields there are $2^{11}$ sub-fields code words, which is equal to 2048 different sub-field arrangements. Of course, the curve can be simply fitted in this plurality of points as mentioned above, for example with the Gaussian fit algorithm and the nearest point can simply be taken. However, another embodiment will be described below which brings some advantages.

In this example the field of possible sub-field code words is reduced by only taking the minimum weight code words (mWC). These code words are all those code words, which have the smallest sub-fields activated for light emission for each video level, i.e. the one, which has the minimum binary value. This coding principle is better explained with an example. The following sub-field organization is considered also for this example:

1 2 3 5 8 12 18 27 41 58 80

The numbers represent the sub-field weights. With this sub-field organization the video level 23 can be coded with the following codes:

| | | | | | | | | | | |
|---|---|---|---|---|---|---|---|---|---|---|
| 0 | 0 | 0 | 1 | 0 | 0 | 1 | 0 | 0 | 0 | 0 |
| 0 | 1 | 1 | 0 | 0 | 0 | 1 | 0 | 0 | 0 | 0 |
| 0 | 0 | 1 | 0 | 1 | 1 | 0 | 0 | 0 | 0 | 0 |
| 1 | 1 | 0 | 0 | 1 | 1 | 0 | 0 | 0 | 0 | 0 |
| **1** | **1** | **1** | **1** | **0** | **1** | **0** | **0** | **0** | **0** | **0** |

From this set of sub-field code words the last one in bold letters is the minimum weight code word. This code has the most entries in the least significant bits. Please note that the LSB is on the left side in this table.

Figure 13:
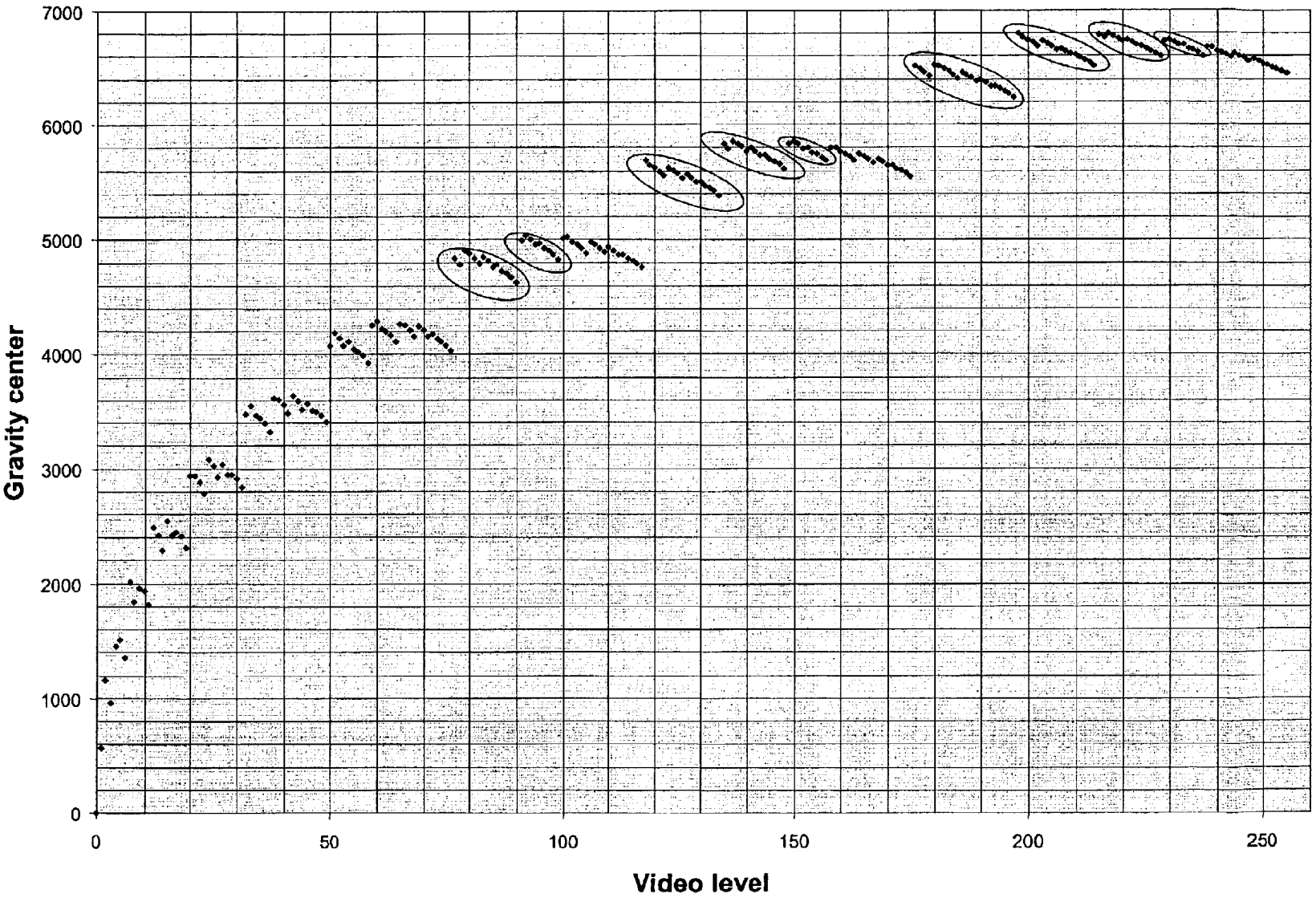
FIG. 13 illustrates a sub-set of points in the temporal centre of gravity versus video level coordinate system selected according to the minimum weight selection rule.

The centre of gravity positions for all possible $2^{11}$=2048 codes, are shown in FIG. 12. From this set of code words the mWC words are indicated in white. From this graph, it is evident that mWC codes also have the minimum centres of gravity from all possible code words. Since the mWC codes make use of the smallest sub-fields in the sub-field organization, they introduce a minimum false contour effect. This is because the false contour effect is directly proportional to the sub-field weights. It is therefore, very advantageous in respect to dynamic false contour effect reduction that the sub-set of video levels is taken from the mWC codes. Of course, all the selected codes shall be on a monotonous rising curve as is explained above. The selection of the code words on the gravity centre curve can be made automatically. This can be done as illustrated in FIG. 13. FIG. 13 depicts all the mWC code words for the above given sub-field organization. It has also been used for FIG. 12 and FIG. 13. In the gravity centre curve shown in FIG. 13 the smallest structure that can be seen apart from the single points are the arches some of them have been marked in the figure with an ellipse. The idea is now to take only one point of each arch if possible. Of course, the created curve has to be monotonously. In fact from the code, it is possible to recognize the points which are on a specific arch. The sub-field code words of all points on an arch have identical entries in the MSBs (radical) but different entries in the LSBs. For example, the code words on the $3^{rd}$ arch from the left have the following radical:

X X X X X X X 1 0 1 0

The sub-field code words on the $4^{th}$ arch from the left have the following radical:

X X X X X X 1 0 1 1 0

The sub-field code words on the $6^{th}$ arch from the left have the following radicals:

X X X X X X X X 1 0 1

Here X stands for the entry 0 or 1 and each X in the sub-field code words can be different from another X entry.

For achieving the best response fidelity for the plasma cells it is advantageous that the selected codes also respect the rule that in each sub-field code word there should never be more than one consecutive 0 entry between two 1 entries, which means that there is never more than one inactivated sub-field between two activated sub-fields for the plasma cell addressing. Such codes are also called refreshing codes because the plasma cells are activated in short succession, therefore, the charge in the cell cannot vanish during a relatively long inactivated period. This concept is already explained in another European Patent Application of the applicant, having the application number 00250066.8. For the disclosure of this refreshing concept it is, therefore, also expressively referred to this European Patent Application. The mWC code words already respect this rule so that every video level can be used which has a corresponding mWC code word. In case of a different sub-field organization, it may be necessary to further limit the mWC code words according to the "single inactivated sub-field rule" in order to get the same result. But this further limitation does not reduce the number of chosen levels a lot and, therefore, it does not cost a lot of flexibility. But on the other hand it brings the important advantage that the response fidelity of the plasma cells is subjectively increased.

For the further automatic selection of the video levels the following algorithm will be used:

The algorithm starts with a selection of the video level zero. Of course, the next video level is the video level 1 and the following video level is the level 2. After this video level the next video level will be chosen which belongs to the next arch and has in addition the smallest centre of gravity superior to the centre of gravity of the previous selected video level. If all the centres of gravity of the next arch are inferior to the previous one, then the next video level will be chosen among the next arch, etc.

The next example better explains this selection process. For example by applying this method from video level 0 to video level 237, which is also a selected GCC code (gravity centre code), having a centre of gravity equal to 6610 and a sub-field code word equal to 1 1 1 1 1 1 0 1 1 1 1, the next video level will be searched among the possible codes having the form:

X X X 1 0 1 1 1 1 1. All possible codes with their centre of gravity are given below:

| | | | | |
|---|---|---|---|---|
| level | 238 | Coded in | 1 1 1 0 1 0 1 1 1 1 1 | Center of gravity 6680 |
| level | 239 | Coded in | 0 1 0 1 1 0 1 1 1 1 1 | Center of gravity 6677 |
| level | 240 | Coded in | 1 1 0 1 1 0 1 1 1 1 1 | Center of gravity 6652 |
| level | 241 | Coded in | 1 0 1 1 1 0 1 1 1 1 1 | Center of gravity 6636 |
| **level** | **242** | **Coded in** | **0 1 1 1 1 0 1 1 1 1 1** | **Center of gravity 6616** |
| level | 243 | Coded in | 1 1 1 1 1 0 1 1 1 1 1 | Center of gravity 6591 |

The lowest centre of gravity is from the video level 243, however this video level cannot be chosen since it has a centre of gravity inferior to the centre of gravity of the previous video level 237. Therefore, the next video level will be chosen to be the video level 242.

Figure 14:
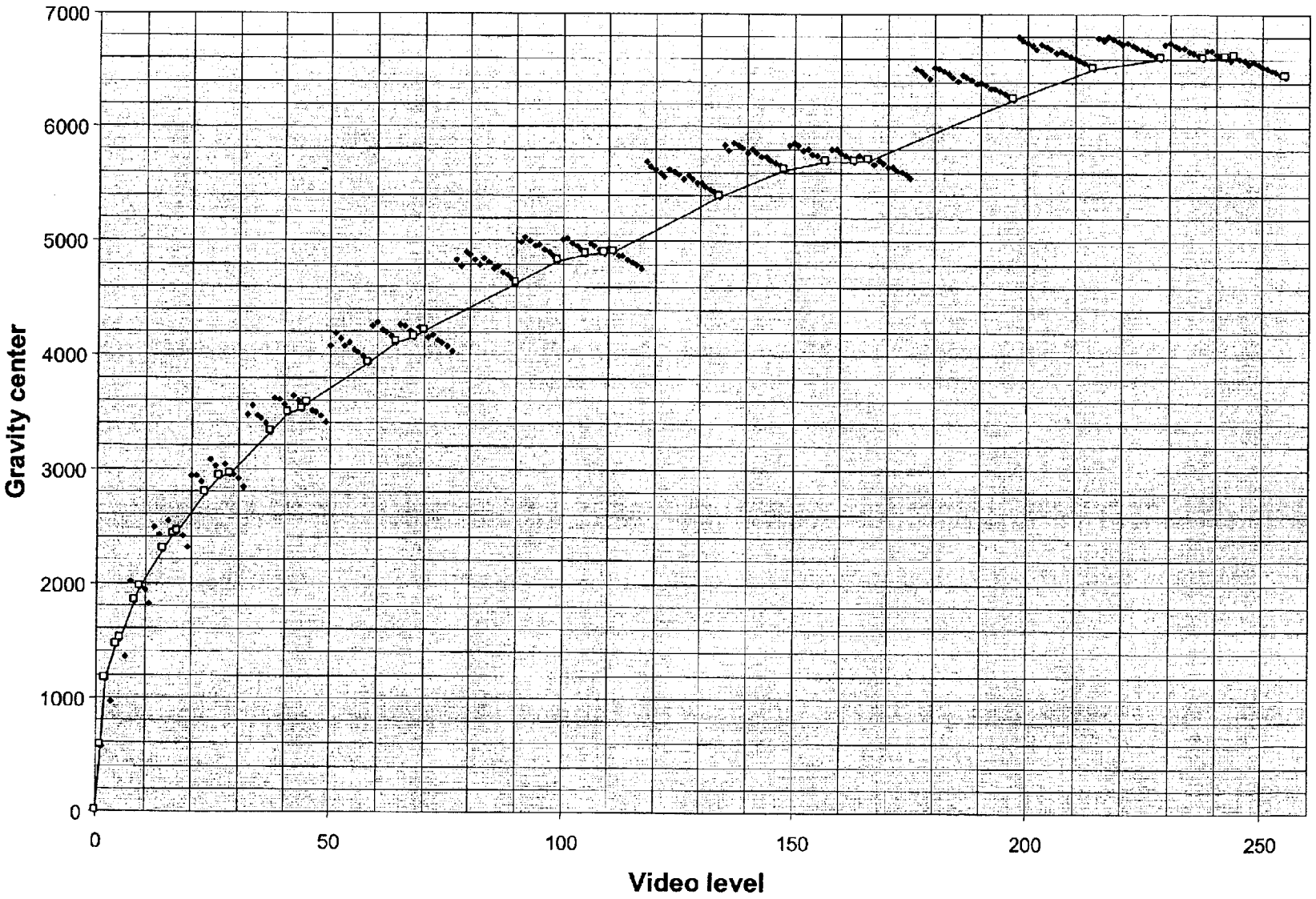
FIG. 14 shows the selection of points from the minimum weight sub-field code words for generating the monotonous rising curve.

FIG. 14 shows all selected GCC codes in form of a dark square among the mWC codes and the resulting monotonous curve. The curve does not monotonously grow only in the high video level range between 242 and 255, which is the maximum video level that is selected. This level is also selected because it does not introduce very much false contour as explained above. From all 256 possible video levels only 37 video levels have been finally selected as the GCC codes. In the table below all mWC codes for all video levels from zero to 255 together with their centre of gravity values have been listed. The selected 37 GCC codes are highlighted with bold letters.

All mWC codes with their Centers of Gravity:

| | | | | |
|---|---|---|---|---|
| **level** | **0** | **Coded in** | **0 0 0 0 0 0 0 0 0 0 0** | **Center of gravity 0** |
| **level** | **1** | **Coded in** | **1 0 0 0 0 0 0 0 0 0 0** | **Center of gravity 575** |
| **level** | **2** | **Coded in** | **0 1 0 0 0 0 0 0 0 0 0** | **Center of gravity 1160** |
| level | 3 | Coded in | 1 1 0 0 0 0 0 0 0 0 0 | Center of gravity 965 |
| **level** | **4** | **Coded in** | **1 0 1 0 0 0 0 0 0 0 0** | **Center of gravity 1460** |
| **level** | **5** | **Coded in** | **0 1 1 0 0 0 0 0 0 0 0** | **Center of gravity 1517** |
| level | 6 | Coded in | 1 1 1 0 0 0 0 0 0 0 0 | Center of gravity 1360 |
| level | 7 | Coded in | 0 1 0 1 0 0 0 0 0 0 0 | Center of gravity 2020 |
| **level** | **8** | **Coded in** | **1 1 0 1 0 0 0 0 0 0 0** | **Center of gravity 1840** |
| **level** | **9** | **Coded in** | **1 0 1 1 0 0 0 0 0 0 0** | **Center of gravity 1962** |
| level | 10 | Coded in | 0 1 1 1 0 0 0 0 0 0 0 | Center of gravity 1941 |
| level | 11 | Coded in | 1 1 1 1 0 0 0 0 0 0 0 | Center of gravity 1816 |
| level | 12 | Coded in | 1 0 1 0 1 0 0 0 0 0 0 | Center of gravity 2486 |
| level | 13 | Coded in | 0 1 1 0 1 0 0 0 0 0 0 | Center of gravity 2429 |
| **level** | **14** | **Coded in** | **1 1 1 0 1 0 0 0 0 0 0** | **Center of gravity 2297** |
| level | 15 | Coded in | 0 1 0 1 1 0 0 0 0 0 0 | Center of gravity 2543 |
| **level** | **16** | **Coded in** | **1 1 0 1 1 0 0 0 0 0 0** | **Center of gravity 2420** |
| **level** | **17** | **Coded in** | **1 0 1 1 1 0 0 0 0 0 0** | **Center of gravity 2450** |
| level | 18 | Coded in | 0 1 1 1 1 0 0 0 0 0 0 | Center of gravity 2411 |
| level | 19 | Coded in | 1 1 1 1 1 0 0 0 0 0 0 | Center of gravity 2315 |
| level | 20 | Coded in | 1 1 0 1 0 1 0 0 0 0 0 | Center of gravity 2938 |
| level | 21 | Coded in | 1 0 1 1 0 1 0 0 0 0 0 | Center of gravity 2938 |
| level | 22 | Coded in | 0 1 1 1 0 1 0 0 0 0 0 | Center of gravity 2884 |
| **level** | **23** | **Coded in** | **1 1 1 1 0 1 0 0 0 0 0** | **Center of gravity 2783** |
| level | 24 | Coded in | 1 0 1 0 1 1 0 0 0 0 0 | Center of gravity 3078 |
| level | 25 | Coded in | 0 1 1 0 1 1 0 0 0 0 0 | Center of gravity 3025 |
| **level** | **26** | **Coded in** | **1 1 1 0 1 1 0 0 0 0 0** | **Center of gravity 2930** |
| level | 27 | Coded in | 0 1 0 1 1 1 0 0 0 0 0 | Center of gravity 3043 |
| **level** | **28** | **Coded in** | **1 1 0 1 1 1 0 0 0 0 0** | **Center of gravity 2955** |
| level | 29 | Coded in | 1 0 1 1 1 1 0 0 0 0 0 | Center of gravity 2955 |
| level | 30 | Coded in | 0 1 1 1 1 1 0 0 0 0 0 | Center of gravity 2915 |
| level | 31 | Coded in | 1 1 1 1 1 1 0 0 0 0 0 | Center of gravity 2839 |
| level | 32 | Coded in | 1 1 1 0 1 0 1 0 0 0 0 | Center of gravity 3474 |
| level | 33 | Coded in | 0 1 0 1 1 0 1 0 0 0 0 | Center of gravity 3550 |
| level | 34 | Coded in | 1 1 0 1 1 0 1 0 0 0 0 | Center of gravity 3462 |

-continued

All mWC codes with their Centers of Gravity:

| | | | | |
|---|---|---|---|---|
| level | 35 | Coded in 1 0 1 1 1 0 1 0 0 0 0 | Center of gravity | 3448 |
| level | 36 | Coded in 0 1 1 1 1 0 1 0 0 0 0 | Center of gravity | 3400 |
| **level** | **37** | **Coded in 1 1 1 1 1 0 1 0 0 0 0** | **Center of gravity** | **3324** |
| level | 38 | Coded in 1 1 0 1 0 1 1 0 0 0 0 | Center of gravity | 3625 |
| level | 39 | Coded in 1 0 1 1 0 1 1 0 0 0 0 | Center of gravity | 3608 |
| level | 40 | Coded in 0 1 1 1 0 1 1 0 0 0 0 | Center of gravity | 3561 |
| **level** | **41** | **Coded in 1 1 1 1 0 1 1 0 0 0 0** | **Center of gravity** | **3488** |
| level | 42 | Coded in 1 0 1 0 1 1 1 0 0 0 0 | Center of gravity | 3640 |
| level | 43 | Coded in 0 1 1 0 1 1 1 0 0 0 0 | Center of gravity | 3596 |
| **level** | **44** | **Coded in 1 1 1 0 1 1 1 0 0 0 0** | **Center of gravity** | **3527** |
| **level** | **45** | **Coded in 0 1 0 1 1 1 1 0 0 0 0** | **Center of gravity** | **3582** |
| level | 46 | Coded in 1 1 0 1 1 1 1 0 0 0 0 | Center of gravity | 3516 |
| level | 47 | Coded in 1 0 1 1 1 1 1 0 0 0 0 | Center of gravity | 3504 |
| level | 48 | Coded in 0 1 1 1 1 1 1 0 0 0 0 | Center of gravity | 3468 |
| level | 49 | Coded in 1 1 1 1 1 1 1 0 0 0 0 | Center of gravity | 3409 |
| level | 50 | Coded in 1 1 1 1 0 1 0 1 0 0 0 | Center of gravity | 4080 |
| level | 51 | Coded in 1 0 1 0 1 1 0 1 0 0 0 | Center of gravity | 4193 |
| level | 52 | Coded in 0 1 1 0 1 1 0 1 0 0 0 | Center of gravity | 4146 |
| level | 53 | Coded in 1 1 1 0 1 1 0 1 0 0 0 | Center of gravity | 4079 |
| level | 54 | Coded in 0 1 0 1 1 1 0 1 0 0 0 | Center of gravity | 4114 |
| level | 55 | Coded in 1 1 0 1 1 1 0 1 0 0 0 | Center of gravity | 4050 |
| level | 56 | Coded in 1 0 1 1 1 1 0 1 0 0 0 | Center of gravity | 4030 |
| level | 57 | Coded in 0 1 1 1 1 1 0 1 0 0 0 | Center of gravity | 3990 |
| **level** | **58** | **Coded in 1 1 1 1 1 1 0 1 0 0 0** | **Center of gravity** | **3931** |
| level | 59 | Coded in 1 1 1 0 1 0 1 1 0 0 0 | Center of gravity | 4257 |
| level | 60 | Coded in 0 1 0 1 1 0 1 1 0 0 0 | Center of gravity | 4286 |
| level | 61 | Coded in 1 1 0 1 1 0 1 1 0 0 0 | Center of gravity | 4225 |
| level | 62 | Coded in 1 0 1 1 1 0 1 1 0 0 0 | Center of gravity | 4204 |
| level | 63 | Coded in 0 1 1 1 1 0 1 1 0 0 0 | Center of gravity | 4165 |
| **level** | **64** | **Coded in 1 1 1 1 1 0 1 1 0 0 0** | **Center of gravity** | **4109** |
| level | 65 | Coded in 1 1 0 1 0 1 1 1 0 0 0 | Center of gravity | 4273 |
| level | 66 | Coded in 1 0 1 1 0 1 1 1 0 0 0 | Center of gravity | 4253 |
| level | 67 | Coded in 0 1 1 1 0 1 1 1 0 0 0 | Center of gravity | 4215 |
| **level** | **68** | **Coded in 1 1 1 1 0 1 1 1 0 0 0** | **Center of gravity** | **4162** |
| level | 69 | Coded in 1 0 1 0 1 1 1 1 0 0 0 | Center of gravity | 4244 |
| **level** | **70** | **Coded in 0 1 1 0 1 1 1 1 0 0 0** | **center of gravity** | **4209** |
| level | 71 | Coded in 1 1 1 0 1 1 1 1 0 0 0 | Center of gravity | 4157 |
| level | 72 | Coded in 0 1 0 1 1 1 1 1 0 0 0 | Center of gravity | 4183 |
| level | 73 | Coded in 1 1 0 1 1 1 1 1 0 0 0 | Center of gravity | 4133 |
| level | 74 | Coded in 1 0 1 1 1 1 1 1 0 0 0 | Center of gravity | 4117 |
| level | 75 | Coded in 0 1 1 1 1 1 1 1 0 0 0 | Center of gravity | 4086 |
| level | 76 | Coded in 1 1 1 1 1 1 1 1 0 0 0 | Center of gravity | 4040 |
| level | 77 | Coded in 0 1 1 1 1 0 1 0 1 0 0 | Center of gravity | 4835 |
| level | 78 | Coded in 1 1 1 1 1 0 1 0 1 0 0 | Center of gravity | 4780 |
| level | 79 | Coded in 1 1 0 1 0 1 1 0 1 0 0 | Center of gravity | 4907 |
| level | 80 | Coded in 1 0 1 1 0 1 1 0 1 0 0 | Center of gravity | 4882 |
| level | 81 | Coded in 0 1 1 1 0 1 1 0 1 0 0 | Center of gravity | 4844 |
| level | 82 | Coded in 1 1 1 1 0 1 1 0 1 0 0 | Center of gravity | 4791 |
| level | 83 | Coded in 1 0 1 0 1 1 1 0 1 0 0 | Center of gravity | 4852 |
| level | 84 | Coded in 0 1 1 0 1 1 1 0 1 0 0 | Center of gravity | 4815 |
| level | 85 | Coded in 1 1 1 0 1 1 1 0 1 0 0 | Center of gravity | 4766 |
| level | 86 | Coded in 0 1 0 1 1 1 1 0 1 0 0 | Center of gravity | 4780 |
| level | 87 | Coded in 1 1 0 1 1 1 1 0 1 0 0 | Center of gravity | 4731 |
| level | 88 | Coded in 1 0 1 1 1 1 1 0 1 0 0 | Center of gravity | 4711 |
| level | 89 | Coded in 0 1 1 1 1 1 1 0 1 0 0 | Center of gravity | 4678 |
| **level** | **90** | **Coded in 1 1 1 1 1 1 1 0 1 0 0** | **Center of gravity** | **4632** |
| level | 91 | Coded in 1 1 1 1 0 1 0 1 1 0 0 | Center of gravity | 4988 |
| level | 92 | Coded in 1 0 1 0 1 1 0 1 1 0 0 | Center of gravity | 5040 |
| level | 93 | Coded in 0 1 1 0 1 1 0 1 1 0 0 | Center of gravity | 5005 |
| level | 94 | Coded in 1 1 1 0 1 1 0 1 1 0 0 | Center of gravity | 4958 |
| level | 95 | Coded in 0 1 0 1 1 1 0 1 1 0 0 | Center of gravity | 4969 |
| level | 96 | Coded in 1 1 0 1 1 1 0 1 1 0 0 | Center of gravity | 4923 |
| level | 97 | Coded in 1 0 1 1 1 1 0 1 1 0 0 | Center of gravity | 4903 |
| level | 98 | Coded in 0 1 1 1 1 1 0 1 1 0 0 | Center of gravity | 4870 |
| **level** | **99** | **Coded in 1 1 1 1 1 1 0 1 1** | **Center of gravity** | **4827** |
| level | 100 | Coded in 1 1 1 0 1 0 1 1 1 0 0 | Center of gravity | 5010 |
| level | 101 | Coded in 0 1 0 1 1 0 1 1 1 0 0 | Center of gravity | 5020 |
| level | 102 | Coded in 1 1 0 1 1 0 1 1 1 0 0 | Center of gravity | 4976 |
| level | 103 | Coded in 1 0 1 1 1 0 1 1 1 0 0 | Center of gravity | 4957 |
| level | 104 | Coded in 0 1 1 1 1 0 1 1 1 0 0 | Center of gravity | 4926 |
| **level** | **105** | **Coded in 1 1 1 1 1 0 1 1 1 0 0** | **Center of gravity** | **4884** |
| level | 106 | Coded in 1 1 0 1 0 1 1 1 1 0 0 | Center of gravity | 4978 |
| level | 107 | Coded in 1 0 1 1 0 1 1 1 1 0 0 | Center of gravity | 4959 |
| level | 108 | Coded in 0 1 1 1 0 1 1 1 1 0 0 | Center of gravity | 4929 |
| **level** | **109** | **Coded in 1 1 1 1 0 1 1 1 1 0 0** | **Center of gravity** | **4889** |
| level | 110 | Coded in 1 0 1 0 1 1 1 1 1 0 0 | Center of gravity | 4934 |
| **level** | **111** | **Coded in 0 1 1 0 1 1 1 1 1 0 0** | **Center of gravity** | **4905** |

-continued

All mWC codes with their Centers of Gravity:

| | | | | |
|---|---|---|---|---|
| level | 112 | Coded in 1 1 1 0 1 1 1 1 1 0 0 | Center of gravity | 4867 |
| level | 113 | Coded in 0 1 0 1 1 1 1 1 1 0 0 | Center of gravity | 4876 |
| level | 114 | Coded in 1 1 0 1 1 1 1 1 1 0 0 | Center of gravity | 4839 |
| level | 115 | Coded in 1 0 1 1 1 1 1 1 1 0 0 | Center of gravity | 4822 |
| level | 116 | Coded in 0 1 1 1 1 1 1 1 1 0 0 | Center of gravity | 4796 |
| level | 117 | Coded in 1 1 1 1 1 1 1 1 1 0 0 | Center of gravity | 4760 |
| level | 118 | Coded in 0 1 0 1 1 0 1 1 0 1 0 | Center of gravity | 5698 |
| level | 119 | Coded in 1 1 0 1 1 0 1 1 0 1 0 | Center of gravity | 5655 |
| level | 120 | Coded in 1 0 1 1 1 0 1 1 0 1 0 | Center of gravity | 5633 |
| level | 121 | Coded in 0 1 1 1 1 0 1 1 0 1 0 | Center of gravity | 5600 |
| level | 122 | Coded in 1 1 1 1 1 0 1 1 0 1 0 | Center of gravity | 5559 |
| level | 123 | Coded in 1 1 0 1 0 1 1 1 0 1 0 | Center of gravity | 5634 |
| level | 124 | Coded in 1 0 1 1 0 1 1 1 0 1 0 | Center of gravity | 5612 |
| level | 125 | Coded in 0 1 1 1 0 1 1 1 0 1 0 | Center of gravity | 5581 |
| level | 126 | Coded in 1 1 1 1 0 1 1 1 0 1 0 | Center of gravity | 5542 |
| level | 127 | Coded in 1 0 1 0 1 1 1 1 0 1 0 | Center of gravity | 5576 |
| level | 128 | Coded in 0 1 1 0 1 1 1 1 0 1 0 | Center of gravity | 5546 |
| level | 129 | Coded in 1 1 1 0 1 1 1 1 0 1 0 | Center of gravity | 5507 |
| level | 130 | Coded in 0 1 0 1 1 1 1 1 0 1 0 | Center of gravity | 5511 |
| level | 131 | Coded in 1 1 0 1 1 1 1 1 0 1 0 | Center of gravity | 5473 |
| level | 132 | Coded in 1 0 1 1 1 1 1 1 0 1 0 | Center of gravity | 5454 |
| level | 133 | Coded in 0 1 1 1 1 1 1 1 0 1 0 | Center of gravity | 5426 |
| **level** | **134** | **Coded in 1 1 1 1 1 1 1 1 0 1 0** | **Center of gravity** | **5390** |
| level | 135 | Coded in 0 1 1 1 1 0 1 0 1 1 0 | Center of gravity | 5834 |
| level | 136 | Coded in 1 1 1 1 1 0 1 0 1 1 0 | Center of gravity | 5795 |
| level | 137 | Coded in 1 1 0 1 0 1 1 0 1 1 0 | Center of gravity | 5860 |
| level | 138 | Coded in 1 0 1 1 0 1 1 0 1 1 0 | Center of gravity | 5839 |
| level | 139 | Coded in 0 1 1 1 0 1 1 0 1 1 0 | Center of gravity | 5810 |
| level | 140 | Coded in 1 1 1 1 0 1 1 0 1 1 0 | Center of gravity | 5773 |
| level | 141 | Coded in 1 0 1 0 1 1 1 0 1 1 0 | Center of gravity | 5801 |
| level | 142 | Coded in 0 1 1 0 1 1 1 0 1 1 0 | Center of gravity | 5773 |
| level | 143 | Coded in 1 1 1 0 1 1 1 0 1 1 0 | Center of gravity | 5737 |
| level | 144 | Coded in 0 1 0 1 1 1 1 0 1 1 0 | Center of gravity | 5738 |
| level | 145 | Coded in 1 1 0 1 1 1 1 0 1 1 0 | Center of gravity | 5703 |
| level | 146 | Coded in 1 0 1 1 1 1 1 0 1 1 0 | Center of gravity | 5684 |
| level | 147 | Coded in 0 1 1 1 1 1 1 0 1 1 0 | Center of gravity | 5657 |
| **level** | **148** | **Coded in 1 1 1 1 1 1 1 0 1 1 0** | **Center of gravity** | **5623** |
| level | 149 | Coded in 1 1 1 1 0 1 0 1 1 1 0 | Center of gravity | 5833 |
| level | 150 | Coded in 1 0 1 0 1 1 0 1 1 1 0 | Center of gravity | 5860 |
| level | 151 | Coded in 0 1 1 0 1 1 0 1 1 1 0 | Center of gravity | 5833 |
| level | 152 | Coded in 1 1 1 0 1 1 0 1 1 1 0 | Center of gravity | 5798 |
| level | 153 | Coded in 0 1 0 1 1 1 0 1 1 1 0 | Center of gravity | 5799 |
| level | 154 | Coded in 1 1 0 1 1 1 0 1 1 1 0 | Center of gravity | 5765 |
| level | 155 | Coded in 1 0 1 1 1 1 0 1 1 1 0 | Center of gravity | 5747 |
| level | 156 | Coded in 0 1 1 1 1 1 0 1 1 1 0 | Center of gravity | 5721 |
| **level** | **157** | **Coded in 1 1 1 1 1 1 0 1 1 1 0** | **Center of gravity** | **5689** |
| level | 158 | Coded in 1 1 1 0 1 0 1 1 1 1 0 | Center of gravity | 5799 |
| level | 159 | Coded in 0 1 0 1 1 0 1 1 1 1 0 | Center of gravity | 5800 |
| level | 160 | Coded in 1 1 0 1 1 0 1 1 1 1 0 | Center of gravity | 5768 |
| level | 161 | Coded in 1 0 1 1 1 0 1 1 1 1 0 | Center of gravity | 5750 |
| level | 162 | Coded in 0 1 1 1 1 0 1 1 1 1 0 | Center of gravity | 5725 |
| **level** | **163** | **Coded in 1 1 1 1 1 0 1 1 1 1 0** | **Center of gravity** | **5694** |
| level | 164 | Coded in 1 1 0 1 0 1 1 1 1 1 0 | Center of gravity | 5749 |
| level | 165 | Coded in 1 0 1 1 0 1 1 1 1 1 0 | Center of gravity | 5732 |
| **level** | **166** | **Coded in 0 1 1 1 0 1 1 1 1 1 0** | **Center of gravity** | **5708** |
| level | 167 | Coded in 1 1 1 1 0 1 1 1 1 1 0 | Center of gravity | 5677 |
| level | 168 | Coded in 1 0 1 0 1 1 1 1 1 1 0 | Center of gravity | 5702 |
| level | 169 | Coded in 0 1 1 0 1 1 1 1 1 1 0 | Center of gravity | 5679 |
| level | 170 | Coded in 1 1 1 0 1 1 1 1 1 1 0 | Center of gravity | 5649 |
| level | 171 | Coded in 0 1 0 1 1 1 1 1 1 1 0 | Center of gravity | 5651 |
| level | 172 | Coded in 1 1 0 1 1 1 1 1 1 1 0 | Center of gravity | 5621 |
| level | 173 | Coded in 1 0 1 1 1 1 1 1 1 1 0 | Center of gravity | 5606 |
| level | 174 | Coded in 0 1 1 1 1 1 1 1 1 1 0 | Center of gravity | 5584 |
| level | 175 | Coded in 1 1 1 1 1 1 1 1 1 1 0 | Center of gravity | 5555 |
| level | 176 | Coded in 1 1 0 1 1 1 0 1 1 0 1 | Center of gravity | 6512 |
| level | 177 | Coded in 1 0 1 1 1 1 0 1 1 0 1 | Center of gravity | 6492 |
| level | 178 | Coded in 0 1 1 1 1 1 0 1 1 0 1 | Center of gravity | 6465 |
| level | 179 | Coded in 1 1 1 1 1 1 0 1 1 0 1 | Center of gravity | 6433 |
| level | 180 | Coded in 1 1 1 0 1 0 1 1 1 0 1 | Center of gravity | 6525 |
| level | 181 | Coded in 0 1 0 1 1 0 1 1 1 0 1 | Center of gravity | 6522 |
| level | 182 | Coded in 1 1 0 1 1 0 1 1 1 0 1 | Center of gravity | 6490 |
| level | 183 | Coded in 1 0 1 1 1 0 1 1 1 0 1 | Center of gravity | 6470 |
| level | 184 | Coded in 0 1 1 1 1 0 1 1 1 0 1 | Center of gravity | 6445 |
| level | 185 | Coded in 1 1 1 1 1 0 1 1 1 0 1 | Center of gravity | 6413 |
| level | 186 | Coded in 1 1 0 1 0 1 1 1 1 0 1 | Center of gravity | 6458 |
| level | 187 | Coded in 1 0 1 1 0 1 1 1 1 0 1 | Center of gravity | 6439 |
| level | 188 | Coded in 0 1 1 1 0 1 1 1 1 0 1 | Center of gravity | 6414 |

-continued

All mWC codes with their Centers of Gravity:

| | | | | |
|---|---|---|---|---|
| level | 189 | Coded in 1 1 1 1 0 1 1 1 1 0 1 | Center of gravity | 6383 |
| level | 190 | Coded in 1 0 1 0 1 1 1 1 1 0 1 | Center of gravity | 6402 |
| level | 191 | Coded in 0 1 1 0 1 1 1 1 1 0 1 | Center of gravity | 6377 |
| level | 192 | Coded in 1 1 1 0 1 1 1 1 1 0 1 | Center of gravity | 6347 |
| level | 193 | Coded in 0 1 0 1 1 1 1 1 1 0 1 | Center of gravity | 6345 |
| level | 194 | Coded in 1 1 0 1 1 1 1 1 1 0 1 | Center of gravity | 6315 |
| level | 195 | Coded in 1 0 1 1 1 1 1 1 1 0 1 | Center of gravity | 6298 |
| level | 196 | Coded in 0 1 1 1 1 1 1 1 1 0 1 | Center of gravity | 6275 |
| **level** | **197** | **Coded in 1 1 1 1 1 1 1 1 1 0 1** | **Center of gravity** | **6246** |
| level | 198 | Coded in 0 1 0 1 1 0 1 1 0 1 1 | Center of gravity | 6798 |
| level | 199 | Coded in 1 1 0 1 1 0 1 1 0 1 1 | Center of gravity | 6766 |
| level | 200 | Coded in 1 0 1 1 1 0 1 1 0 1 1 | Center of gravity | 6747 |
| level | 201 | Coded in 0 1 1 1 1 0 1 1 0 1 1 | Center of gravity | 6722 |
| level | 202 | Coded in 1 1 1 1 1 0 1 1 0 1 1 | Center of gravity | 6692 |
| level | 203 | Coded in 1 1 0 1 0 1 1 1 0 1 1 | Center of gravity | 6732 |
| level | 204 | Coded in 1 0 1 1 0 1 1 1 0 1 1 | Center of gravity | 6713 |
| level | 205 | Coded in 0 1 1 1 0 1 1 1 0 1 1 | Center of gravity | 6689 |
| level | 206 | Coded in 1 1 1 1 0 1 1 1 0 1 1 | Center of gravity | 6659 |
| level | 207 | Coded in 1 0 1 0 1 1 1 1 0 1 1 | Center of gravity | 6675 |
| level | 208 | Coded in 0 1 1 0 1 1 1 1 0 1 1 | Center of gravity | 6651 |
| level | 209 | Coded in 1 1 1 0 1 1 1 1 0 1 1 | Center of gravity | 6622 |
| level | 210 | Coded in 0 1 0 1 1 1 1 1 0 1 1 | Center of gravity | 6619 |
| level | 211 | Coded in 1 1 0 1 1 1 1 1 0 1 1 | Center of gravity | 6590 |
| level | 212 | Coded in 1 0 1 1 1 1 1 1 0 1 1 | Center of gravity | 6573 |
| level | 213 | Coded in 0 1 1 1 1 1 1 1 0 1 1 | Center of gravity | 6550 |
| **level** | **214** | **Coded in 1 1 1 1 1 1 1 1 0 1 1** | **Center of gravity** | **6522** |
| level | 215 | Coded in 0 1 1 1 1 0 1 0 1 1 1 | Center of gravity | 6796 |
| level | 216 | Coded in 1 1 1 1 1 0 1 0 1 1 1 | Center of gravity | 6767 |
| level | 217 | Coded in 1 1 0 1 0 1 1 0 1 1 1 | Center of gravity | 6804 |
| level | 218 | Coded in 1 0 1 1 0 1 1 0 1 1 1 | Center of gravity | 6786 |
| level | 219 | Coded in 0 1 1 1 0 1 1 0 1 1 1 | Center of gravity | 6763 |
| level | 220 | Coded in 1 1 1 1 0 1 1 0 1 1 1 | Center of gravity | 6735 |
| level | 221 | Coded in 1 0 1 0 1 1 1 0 1 1 1 | Center of gravity | 6749 |
| level | 222 | Coded in 0 1 1 0 1 1 1 0 1 1 1 | Center of gravity | 6727 |
| level | 223 | Coded in 1 1 1 0 1 1 1 0 1 1 1 | Center of gravity | 6699 |
| level | 224 | Coded in 0 1 0 1 1 1 1 0 1 1 1 | Center of gravity | 6696 |
| level | 225 | Coded in 1 1 0 1 1 1 1 0 1 1 1 | Center of gravity | 6669 |
| level | 226 | Coded in 1 0 1 1 1 1 1 0 1 1 1 | Center of gravity | 6652 |
| level | 227 | Coded in 0 1 1 1 1 1 1 0 1 1 1 | Center of gravity | 6631 |
| **level** | **228** | **Coded in 1 1 1 1 1 1 1 0 1 1 1** | **Center of gravity** | **6604** |
| level | 229 | Coded in 1 1 1 1 0 1 0 1 1 1 1 | Center of gravity | 6737 |
| level | 230 | Coded in 1 0 1 0 1 1 0 1 1 1 1 | Center of gravity | 6750 |
| level | 231 | Coded in 0 1 1 0 1 1 0 1 1 1 1 | Center of gravity | 6728 |
| level | 232 | Coded in 1 1 1 0 1 1 0 1 1 1 1 | Center of gravity | 6702 |
| level | 233 | Coded in 0 1 0 1 1 1 0 1 1 1 1 | Center of gravity | 6699 |
| level | 234 | Coded in 1 1 0 1 1 1 0 1 1 1 1 | Center of gravity | 6673 |
| level | 235 | Coded in 1 0 1 1 1 1 0 1 1 1 1 | Center of gravity | 6657 |
| level | 236 | Coded in 0 1 1 1 1 1 0 1 1 1 1 | Center of gravity | 6636 |
| **level** | **237** | **Coded in 1 1 1 1 1 1 0 1 1 1 1** | **Center of gravity** | **6610** |
| level | 238 | Coded in 1 1 1 1 1 1 0 1 1 1 1 | Center of gravity | 6680 |
| level | 239 | Coded in 0 1 0 1 1 0 1 1 1 1 1 | Center of gravity | 6677 |
| level | 240 | Coded in 1 1 0 1 1 0 1 1 1 1 1 | Center of gravity | 6652 |
| level | 241 | Coded in 1 0 1 1 1 0 1 1 1 1 1 | Center of gravity | 6636 |
| **level** | **242** | **Coded in 0 1 1 1 1 0 1 1 1 1 1** | **Center of gravity** | **6616** |
| level | 243 | Coded in 1 1 1 1 1 0 1 1 1 1 1 | Center of gravity | 6591 |
| **level** | **244** | **Coded in 1 1 0 1 0 1 1 1 1 1 1** | **Center of gravity** | **6625** |
| level | 245 | Coded in 1 0 1 1 0 1 1 1 1 1 1 | Center of gravity | 6610 |
| level | 246 | Coded in 0 1 1 1 0 1 1 1 1 1 1 | Center of gravity | 6590 |
| level | 247 | Coded in 1 1 1 1 0 1 1 1 1 1 1 | Center of gravity | 6566 |
| level | 248 | Coded in 1 0 1 0 1 1 1 1 1 1 1 | Center of gravity | 6579 |
| level | 249 | Coded in 0 1 1 0 1 1 1 1 1 1 1 | Center of gravity | 6559 |
| level | 250 | Coded in 1 1 1 0 1 1 1 1 1 1 1 | Center of gravity | 6535 |
| level | 251 | Coded in 0 1 0 1 1 1 1 1 1 1 1 | Center of gravity | 6533 |
| level | 252 | Coded in 1 1 0 1 1 1 1 1 1 1 1 | Center of gravity | 6510 |
| level | 253 | Coded in 1 0 1 1 1 1 1 1 1 1 1 | Center of gravity | 6496 |
| level | 254 | Coded in 0 1 1 1 1 1 1 1 1 1 1 | Center of gravity | 6477 |
| **level** | **255** | **Coded in 1 1 1 1 1 1 1 1 1 1 1** | **Center of gravity** | **6454** |

The sub-field code words for the GCC coding are also listed in the next table.

GCC codes with their Centers of Gravity:

| | | | | |
|---|---|---|---|---|
| level | 0 | Coded in 0 0 0 0 0 0 0 0 0 0 0 | Center of gravity | 0 |
| level | 1 | Coded in 1 0 0 0 0 0 0 0 0 0 0 | Center of gravity | 575 |
| level | 2 | Coded in 0 1 0 0 0 0 0 0 0 0 0 | Center of gravity | 1160 |
| level | 4 | Coded in 1 0 1 0 0 0 0 0 0 0 0 | Center of gravity | 1460 |
| level | 5 | Coded in 0 1 1 0 0 0 0 0 0 0 0 | Center of gravity | 1517 |
| level | 8 | Coded in 1 1 0 1 0 0 0 0 0 0 0 | Center of gravity | 1840 |
| level | 9 | Coded in 1 0 1 1 0 0 0 0 0 0 0 | Center of gravity | 1962 |
| level | 14 | Coded in 1 1 1 0 1 0 0 0 0 0 0 | Center of gravity | 2297 |
| level | 16 | Coded in 1 1 0 1 1 0 0 0 0 0 0 | Center of gravity | 2420 |
| level | 17 | Coded in 1 0 1 1 1 0 0 0 0 0 0 | Center of gravity | 2450 |
| level | 23 | Coded in 1 1 1 1 0 1 0 0 0 0 0 | Center of gravity | 2783 |
| level | 26 | Coded in 1 1 1 0 1 1 0 0 0 0 0 | Center of gravity | 2930 |
| level | 28 | Coded in 1 1 0 1 1 1 0 0 0 0 0 | Center of gravity | 2955 |
| level | 37 | Coded in 1 1 1 1 1 0 1 0 0 0 0 | Center of gravity | 3324 |
| level | 41 | Coded in 1 1 1 1 0 1 1 0 0 0 0 | Center of gravity | 3488 |
| level | 44 | Coded in 1 1 1 0 1 1 1 0 0 0 0 | Center of gravity | 3527 |
| level | 45 | Coded in 0 1 0 1 1 1 1 0 0 0 0 | Center of gravity | 3582 |
| level | 58 | Coded in 1 1 1 1 1 1 0 1 0 0 0 | Center of gravity | 3931 |
| level | 64 | Coded in 1 1 1 1 1 0 1 1 0 0 0 | Center of gravity | 4109 |
| level | 68 | Coded in 1 1 1 1 0 1 1 1 0 0 0 | Center of gravity | 4162 |
| level | 70 | Coded in 0 1 1 0 1 1 1 1 0 0 0 | Center of gravity | 4209 |
| level | 90 | Coded in 1 1 1 1 1 1 1 0 1 0 0 | Center of gravity | 4632 |
| level | 99 | Coded in 1 1 1 1 1 1 0 1 1 0 0 | Center of gravity | 4827 |
| level | 105 | Coded in 1 1 1 1 1 0 1 1 1 0 0 | Center of gravity | 4884 |
| level | 109 | Coded in 1 1 1 1 0 1 1 1 1 0 0 | Center of gravity | 4889 |
| level | 111 | Coded in 0 1 1 0 1 1 1 1 1 0 0 | Center of gravity | 4905 |
| level | 134 | Coded in 1 1 1 1 1 1 1 1 0 1 0 | Center of gravity | 5390 |
| level | 148 | Coded in 1 1 1 1 1 1 1 0 1 1 0 | Center of gravity | 5623 |
| level | 157 | Coded in 1 1 1 1 1 1 0 1 1 1 0 | Center of gravity | 5689 |
| level | 163 | Coded in 1 1 1 1 1 0 1 1 1 1 0 | Center of gravity | 5694 |
| level | 166 | Coded in 0 1 1 1 0 1 1 1 1 1 0 | Center of gravity | 5708 |
| level | 197 | Coded in 1 1 1 1 1 1 1 1 1 0 1 | Center of gravity | 6246 |
| level | 214 | Coded in 1 1 1 1 1 1 1 1 0 1 1 | Center of gravity | 6522 |
| level | 228 | Coded in 1 1 1 1 1 1 1 0 1 1 1 | Center of gravity | 6604 |
| level | 237 | Coded in 1 1 1 1 1 1 0 1 1 1 1 | Center of gravity | 6610 |
| level | 242 | Coded in 0 1 1 1 1 0 1 1 1 1 1 | Center of gravity | 6616 |
| level | 244 | Coded in 1 1 0 1 0 1 1 1 1 1 1 | Center of gravity | 6625 |
| level | 255 | Coded in 1 1 1 1 1 1 1 1 1 1 1 | Center of gravity | 6454 |

Figure 15:
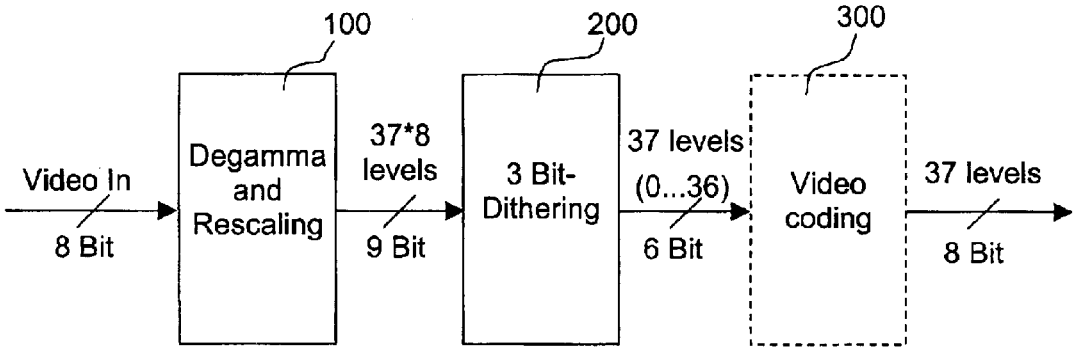
FIG. 15 shows a first block diagram of the circuit implementation of the invention.

A further reduction of this sub-set of m video levels can be advantageous in order to optimise the linearity of the response characteristic. E.g. the two video levels 44 and 45 are very close together but their code words differ in three bit positions. This can result in a different perception of the video levels on the human eye, more different than necessary from the bare video level values. Therefore, it is reasonable to further decimate the m video levels and take either video level 44 or 45 for the sub-field coding. Once the video levels ($V_i$, 0<= i<m) of the sub-set of video levels have been chosen, the image picture has to be encoded with these levels. A circuit implementation of this process is shown in FIG. 15. In the first block, the input video data coded on 8 bit standard binary code needs to be applied to a Degamma function. This is because the PDP has a linear response characteristic whereas the CRT displays rather have a quadratic response characteristic to the beam intensity. This is well-known in the art and for that reason at the video source, for example in the studio or in the camera itself, the video signal is Gamma corrected so that the picture seen by the human eye via a CRT display will get the correct brightness impression. These pre-corrected pictures are broadcast and in the TV receivers the pictures are automatically displayed with the correct linear response because of the gamma function-like response characteristic of the picture tubes. The human eye will observe the correct colour impressions. The Degamma function will be applied to the input video data in block 100. In block 100 also a resealing task is performed. This means that the Degamma data due to calculation accuracy being 16 bit data words is rescaled to the range between 0 and m, where m is the number of levels used during GCC coding. However, each video level $V_i$ of the set of m levels needs to be represented with 3 bits of precision. In case that m is equal to 37 as in the example above, 6 bits are required to differentiate between these levels. However, as every level shall be represented with 3 bits of precision, in total 9 bits, are output from the Degamma and resealing look-up table in block 100. In decimal values the output values will have the form X.0; X.125; X.25; . . . X.875; X+1.0. In the next block 200 three dithering bits are added to the input values.

Dithering is a well-known technique for increasing the grey level resolution. With dithering, some artificial levels are added in between the existing video levels. This improves the grey scale portrayal but on the other hand adds high frequency low amplitude dithering noise, which is perceptible to the human viewer only at a small viewing distance. A full description of the dithering technique, which also is adapted to the PDP technology is known from the further European Patent Application of the applicant 00250099.9. For the disclosure of the dithering technique it is, therefore, expressively referred also to this patent application. The resulting 9 bit data words are truncated in block 200 to the final bit resolution for the 37 video levels. The final bit resolution is 6 bits and, therefore, 3 bits are truncated after addition of 3 dithering bits.

The final 6 bit video data is input to an optional video coding look-up table in block 300. This look-up table is used to assign to each of the 37 video levels the corresponding correct 8 bit video level. This is done in order to leave the sub-field coding unit relatively unchanged. With this structure it is possible to implement the GCC coding according to the invention completely on the video level-processing block. Of course, in the sub-field coding unit which follows block 300, there needs to be a corresponding sub-field coding look-up table, which assigns to each of the output video levels the correct GCC code word for addressing the plasma display panel. In an alternative embodiment block 300 can be omitted and the 6 bit output video data in block 200 can be directly input into the sub-field encoding unit if the sub-field encoding unit shall be designed in new form. This is not necessary in case of the first above-mentioned embodiment.

Figure 16:
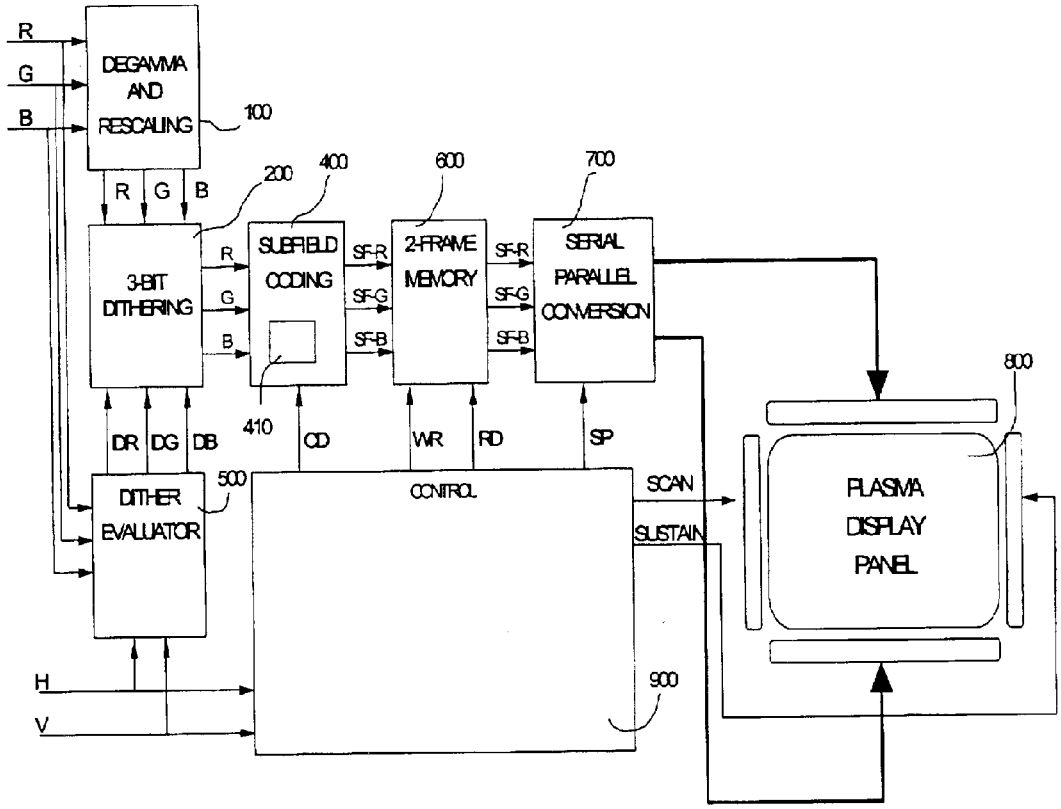
FIG. 16 shows a more detailed block diagram for the implementation of the invention in the video processing stages before sub-field encoding.

In FIG. 16 a circuit implementation of the invention is illustrated. Input R, G, B video data is forwarded to Degamma unit 100 and a dither evaluation unit 500. The Degamma unit 100 performs the 16 bit Degamma function and resealing and delivers 9 bit video data R, G, B at the output. The dither evaluation unit 500 computes the dithering numbers DR for red, DG for green and DB for the blue colour component. To do that it requires the Sync-signals HV to determine which pixel is currently processed and which line and frame number is valid. A full description of how the dithering numbers are calculated and what dithering pattern is used is contained in above-mentioned EP application of the applicant. In block 200 the resulting dithering numbers and the Degamma output values are added and the 3 least significant bits of the result are truncated so that the final output values are R, G and B are achieved. These values are forwarded to a sub-field coding unit 400, which performs sub-field coding under control of control unit 900. The sub-field code words are read out of the look-up table 410 in sub-field coding unit 400 preferably. The sub-field code words are forwarded to a memory unit 600. The control unit 900 also controls reading and writing from and to this memory unit. For plasma display addressing, the sub-field code words are read out of the memory device and all the code words for one line are collected in order to create a single very long code word, which can be used for the line-wise PDP addressing. This is carried out in the serial to parallel conversion unit 700. The control unit 900 generates all scan and sustain pulses for PDP control. It receives vertical and horizontal synchronising signals for reference timing.

The invention can be used in particular in PDPs. Plasma displays are currently used in consumer electronics, e.g. for TV sets and also for a monitor for computers. However, use of the invention is also appropriate for matrix displays where the light generation is also controlled with small pulses in sub-fields, i.e. where the PWM principle is used for controlling light generation.

What is claimed:

1. Method for processing video pictures especially for dynamic false contour effect compensation, the video picture consisting of pixels having at least one colour component (RGB) the colour component values being digitally coded with a digital code word, hereinafter called sub-field code word (SF-R, SF-G, F-B) wherein t each bit of a sub-field code word (SF-R, SF-G, SF-B) a certain duration is assigned hereinafter called sub-field, during which a colour component of the pixel can be activated for light generation, with the digital code words having n bit, characterised in that among the set p possible video levels for the a least one colour component (RGB) a sub-set of m video levels with n<m<p is selected which is used for light generation, wherein the m values are selected according to the rule that the temporal centre of gravity (CG1, CG2, CG3) for the light generation of the corresponding sub-field code words grow continuously with the video level apart from possible exceptions in the low video level range up to a first predefined limit and/or in the high video level range from a second predefined limit on, wherein in case of a sub-field organization characterised by a specific number of sub-fields with a specific series of sub-field weights for a colour component value, more than one corresponding sub-field code word exists, the set of possible sub-field code words is reduced by taking only those sub-field code words for each video level, which have the minimum binary value for the case that in a sub-field code word the weight of each bit is ordered according to size; and wherein the decimated set of available sub-field code words is further reduced by selecting from the minimum binary value sub-field code words only those code words, in which never more than one consecutive "0", inactivated sub-field, follow in between two "1" code word entries activated sub-field.

2. Method for processing video pictures especially for dynamic false contour effect compensation, the video picture consisting of pixels having at least one colour component (RGB) the colour component values being digitally coded with a digital code word, hereinafter called sub-field code word (SF-R, SF-G, F-B) wherein to each bit of a sub-field code word (SF-R, SF-G, SF-B) a certain duration is assigned hereinafter called sub-field, during which a colour component of the pixel can be activated for light generation, with the digital code words having n bits, characterised in that among the set p possible video levels for the a least one colour component (RGB) a sub-set of m video levels with n<m<p is selected, which is used for light generation, wherein the m values are selected according to the rule that the temporal centre of gravity (CG1, CG2, CG3) for the light generation of the corresponding sub-field code words grow continuously with the video level apart from possible exceptions in the low video level range up to a first predefined limit and/or in the high video level range from a second predefined limit on, and wherein the selection of video levels from the further reduced set of sub-field code words is performed by taking only one video level on each group of sub-field code words having the same radical on the MSB side, namely the video level belonging to the next higher group of sub-field code words and having the smallest centre of gravity superior to the centre of gravity of the previous selected video level, wherein in case that the next higher group of sub-field code words does not provide a sub-field code word having a centre of gravity inferior to the previous one, then the second next higher sub-field code word group will be chosen for selecting the next video level.

3. Method according to claim 2, wherein the selected video levels from the further reduced set of sub-field code words is further decimated according to the aspect of response characteristic optimisation.

4. Method for processing video pictures especially for dynamic false contour effect compensation, the video picture consisting of pixels having at least one colour component (RGB) the colour component values being digitally coded with a digital code word, hereinafter called sub-field code word (SF-R, SF-G, F-B) wherein to each bit of a sub-field code word (SF-R, SF-G, SF-B) a certain duration is assigned hereinafter called sub-field, during which a colour component of the pixel can be activated for light generation, with the digital code words having n bits, characterised in that among the set p possible video levels for the at least one colour component (RGB) a sub-set of m video levels with n<m<p is selected, which is used for light generation, wherein the m values are selected according to the rule that the temporal centre of gravity (CG1, CG2, CG3) for the light generation of the corresponding sub-field code words grow continuously with the video level apart from possible exceptions in the low video level range up to a first predefined limit and/or in the high video level range from a second predefined limit on, and wherein the temporal centre of gravity (CG1, CG2, CG3) for the light generation is defined according to the following formula:

$$CG(\text{code}) = \frac{\sum_{i=1}^{n} sfW_i * \delta_i(\text{code}) * sfCG_i}{\sum_{i=1}^{n} sfW_i * \delta_i(\text{code})}$$

there $sfW_i$ is the sub-field weight of the $i^{th}$ sub-field, i is equal to 1 if the $i^{th}$ sub-field is activated and zero if the $i^{th}$ sub-field is inactivated and $sfCG_i$ is the temporal centre of gravity for the light generation of the $i^{th}$ sub-field.

5. Method for processing video pictures especially for dynamic false contour effect compensation, the video picture consisting of pixels having at least one colour component (RGB) the colour component values being digitally coded with a digital code word, hereinafter called sub-field code word (SF-R, SF-G, F-B) wherein to each bit of a sub-field code word (SF-R, SF-G, SF-B) a certain duration is assigned hereinafter called sub-field, during which a colour component of the pixel can be activated for light generation, with the digital code words having n bits, characterised in that among the set p possible video levels for the least one colour component (RGB) a sub-set of m video levels with n<m<p is selected, which is used for light generation, wherein the m values are selected according to the rule that the temporal centre of gravity (CG1, CG2, CG3) for the light generation of the corresponding sub-field code words grow continuously with the video level apart from possible exceptions in the low video level range up to a first redefined limit and/or in the high video level range from a second predefined limit on, and wherein the first predefined limit is about 10% of the maximum video level and/or the second predefined limit is about 80% of the maximum video level.

6. Apparatus for processing video pictures, especially for a dynamic false contour effect compensation, the video picture consisting of pixels having at least one colour component (RGB), the apparatus having included i) a video processing unit (100, 200) for processing video picture data, said video picture data comprising video level pixel data for a colour component, ii) a sub-field coding unit (13) in which the video level data is converted into sub-field code words, in which to each it of the sub-field code words a certain duration is assigned during which the corresponding element of the pixel may be activated for light generation, hereinafter this period is called sub-field, and a sub-field code word having n bits, characterised in that said apparatus further includes;

iii) a look-up table (410) for the sub-field coding process, in which the sub-field code words for only a sub-set m of video levels of p possible video levels are assigned to input video level data, with n<m<p and the m video levels when ordered according to size being selected according to the rule that the temporal centres of gravity (CG1, CG2, CG3) for the light generation of the corresponding sub-field code words grow continuously apart from exceptions in the low video level range up to a first predefined limit and/or in the high video level range from a second predefined limit on, and wherein said apparatus having further included a dithering unit (200), in which dithering values are added to said video level pixel data for a colour component to increase the grey scale protrayal.

7. Apparatus for processing video pictures, especially for a dynamic false contour effect compensation, the video picture consisting of pixels having at least one colour component (RGB), the apparatus having included i) a video processing unit (100, 200) for processing video picture data, said video picture data comprising video level pixel data for a colour component, ii) a sub-field coding unit (13) in which the video level data is converted into sub-field code words, in which to each it of the sub-field code words a certain duration is assigned during which the corresponding element of the pixel may be activated for light generation, hereinafter this period is called sub-field, and a sub-field code word having n bits, characterised in that said apparatus further includes;

iii) a look-up table (410) for the sub-field coding process, in which the sub-field code words for only a sub-set m of video levels of p possible video levels are assigned to input video level data, with n<m<p and the m video levels when ordered according to size being selected according to the rule that the temporal centres of gravity (CG1, CG2, CG3) for the light generation of the corresponding sub-field code words grow continuously apart from exceptions in the low video level range up to a first predefined limit and/or in the high video level range from a second predefined limit on, and wherein said apparatus having further included a Degamma unit (100) in which the input video levels are amplified to compensate for the gamma correction in the video source.

8. Apparatus for processing video pictures, especially for a dynamic false contour effect compensation, the video picture consisting of pixels having at least one colour component (RGB), the apparatus having included i) a video processing unit (100, 200) for processing vide picture data, said video picture data comprising video level pixel data for a colour component, ii) a sub-field coding unit (13) in which the video level data is converted into sub-field code words, in which to each it of the sub-field code words a certain duration is assigned during which the corresponding element of the pixel may be activated for light generation, hereinafter this period is called sub-field, and a sub-field code word having n bits, characterised in that said apparatus further includes;

iii) a look-up table (410) for the sub-field coding process, in which the sub-field code words for only a sub-set m of video levels of p possible video levels are assigned to input video level data, with n<m<p and the m video levels when ordered according to size being selected according to the rule that the temporal centres of gravity (CG1, CG2, CG3) for the light generation of the corresponding sub-field code words grow continuously apart from exceptions in the low video level range up to a first predefined limit and/or in the high video level range from a second predefined limit on, and wherein said apparatus having further included a look-up table (300) that assigns to an output value of the dithering unit (200) a corresponding full bit resolution video level.

* * * * *